US012385682B2

(12) United States Patent
Park et al.

(10) Patent No.: US 12,385,682 B2
(45) Date of Patent: Aug. 12, 2025

(54) REFRIGERATOR

(71) Applicant: LG ELECTRONICS INC, Seoul (KR)

(72) Inventors: Kyong Bae Park, Seoul (KR); Sangbok Choi, Seoul (KR); Sungwook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 175 days.

(21) Appl. No.: 18/019,337

(22) PCT Filed: Jul. 19, 2021

(86) PCT No.: PCT/KR2021/009252

§ 371 (c)(1),
(2) Date: Feb. 2, 2023

(87) PCT Pub. No.: WO2022/030806

PCT Pub. Date: Feb. 10, 2022

(65) Prior Publication Data

US 2023/0304723 A1 Sep. 28, 2023

(30) Foreign Application Priority Data

Aug. 6, 2020 (KR) ..... 10-2020-0098359

(51) Int. Cl.
*F25D 17/08* (2006.01)
*F25D 21/02* (2006.01)

(52) U.S. Cl.
CPC ..... *F25D 17/08* (2013.01); *F25D 21/02* (2013.01); *F25B 2700/11* (2013.01); *F25D 2700/121* (2013.01); *F25D 2700/14* (2013.01)

(58) Field of Classification Search
CPC ..... F25D 17/08; F25D 17/067; F25D 21/02; F25D 21/002; F25D 21/004; F25D 21/006; F25D 21/008; F25D 21/025; F25D 2700/121; F25D 2700/14; F25D 2700/10
See application file for complete search history.

(56) References Cited

U.S. PATENT DOCUMENTS 3,355,904 A * 12/1967 Sutton, Jr. ..... G05D 11/13 73/196
3,465,534 A * 9/1969 Schweiger ..... G01P 5/12 62/276
3,643,457 A * 2/1972 Winkler ..... F24F 5/001 62/151
11,493,260 B1 * 11/2022 Carden ..... F25D 21/008
(Continued)

FOREIGN PATENT DOCUMENTS

DE 102006048880 A1 * 4/2008 ..... F25D 21/002
EP 2722619 A 4/2014
(Continued)

*Primary Examiner* — Andrew Roersma
(74) *Attorney, Agent, or Firm* — Bryan Cave Leighton Paisner LLP

(57) ABSTRACT

A refrigerator is configured such that a controller may control the frost detecting operation to be differently performed on the basis of at least one of a room temperature and a set reference temperature. Thus, precise frosting detection may be performed and power consumption due to the frosting detection may be minimized, and power consumption efficiency may be improved.

13 Claims, 16 Drawing Sheets

(56) References Cited

U.S. PATENT DOCUMENTS

| | | | | |
|---|---|---|---|---|
| 2014/0053581 | A1* | 2/2014 | Cho | F25D 21/008 62/155 |
| 2018/0274827 | A1* | 9/2018 | Kim | F25B 21/04 |
| 2019/0072310 | A1* | 3/2019 | Choi | F25D 21/006 |
| 2019/0271497 | A1* | 9/2019 | Guanye | F25B 5/00 |
| 2020/0018526 | A1 | 1/2020 | Oh et al. | |
| 2021/0127854 | A1* | 5/2021 | Krishnamoorthy | A47F 3/043 |
| 2023/0280081 | A1* | 9/2023 | Park | F25D 21/02 62/80 |
| 2023/0288123 | A1* | 9/2023 | Park | F25B 47/02 |
| 2023/0288124 | A1* | 9/2023 | Park | F25D 21/08 |
| 2023/0288125 | A1* | 9/2023 | Park | F28D 1/0477 |
| 2024/0011697 | A1* | 1/2024 | Park | F25D 21/08 |

FOREIGN PATENT DOCUMENTS

| | | | | | |
|---|---|---|---|---|---|
| JP | 6270375 | A | | 3/2015 | |
| JP | 2019039586 | A | * | 3/2019 | |
| KR | 1020140050959 | A | * | 4/2014 | |
| KR | 10-2016-0027761 | A | | 3/2016 | |
| KR | 10-2019-0112482 | A | | 10/2019 | |
| WO | WO-0235165 | A1 | * | 5/2002 | F25D 21/002 |
| WO | 2019190113 | A1 | | 3/2019 | |
| WO | WO-2019190114 | A1 | * | 10/2019 | F25D 17/04 |

* cited by examiner

【Figure 1】
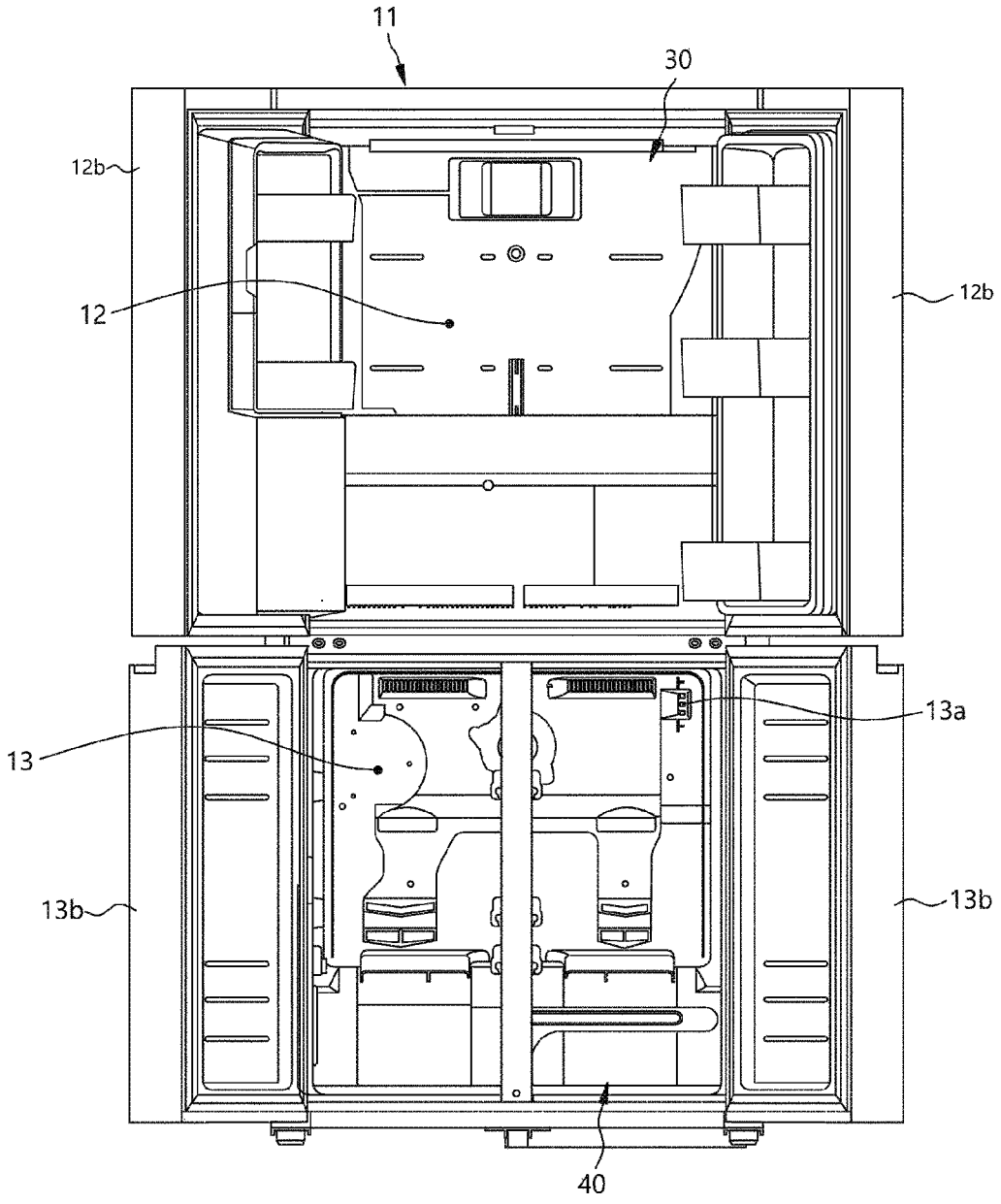

【Figure 2】
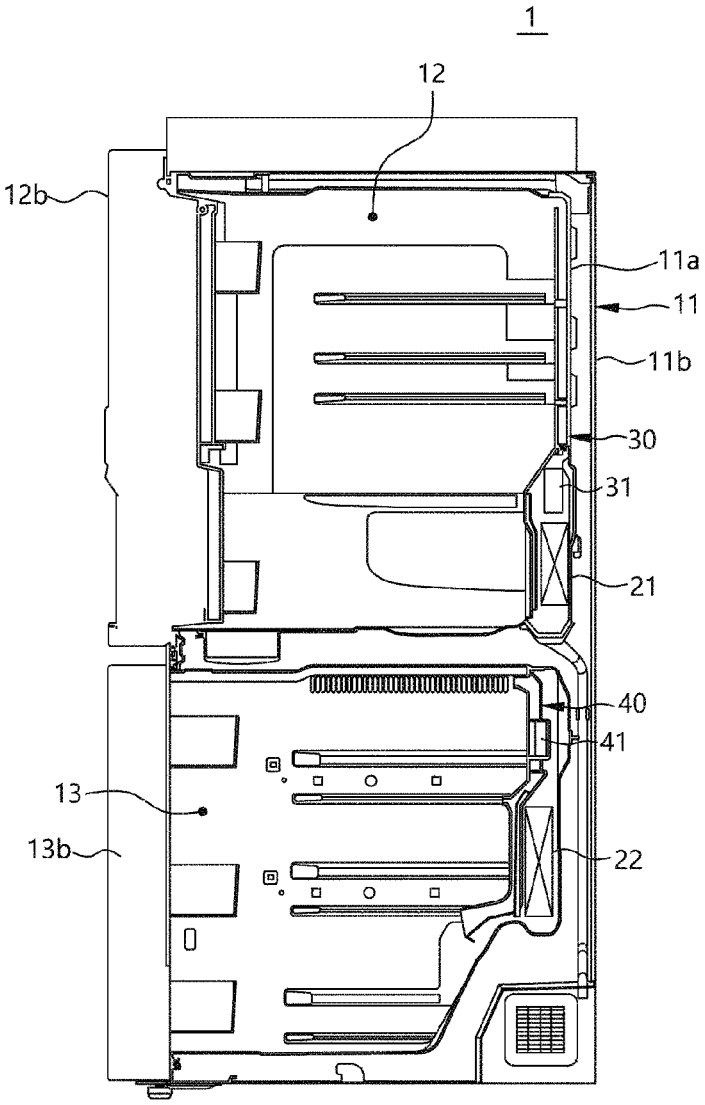

【Figure 3】
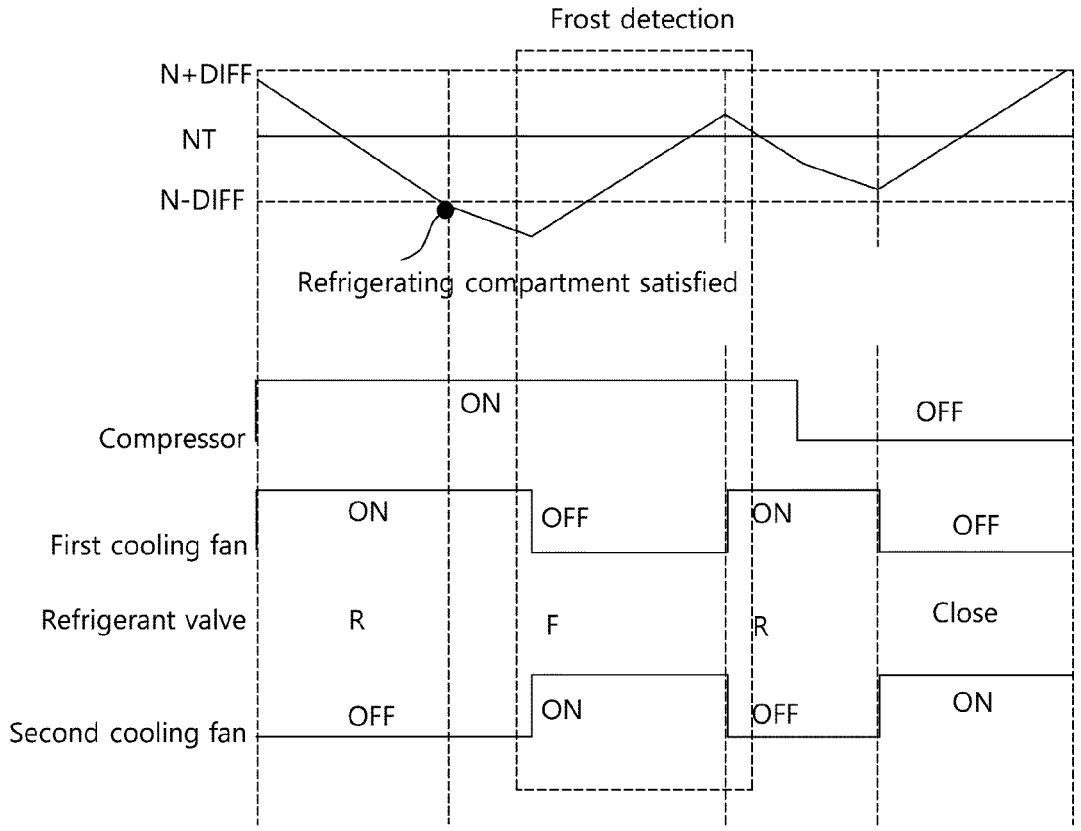
【Figure 4】
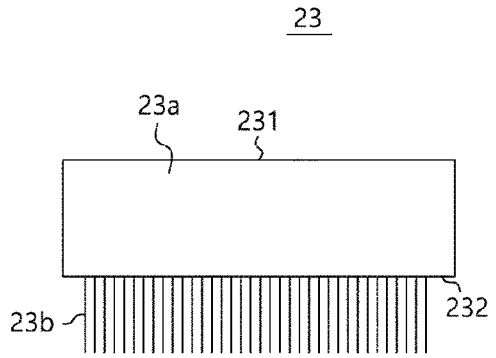

【Figure 5】
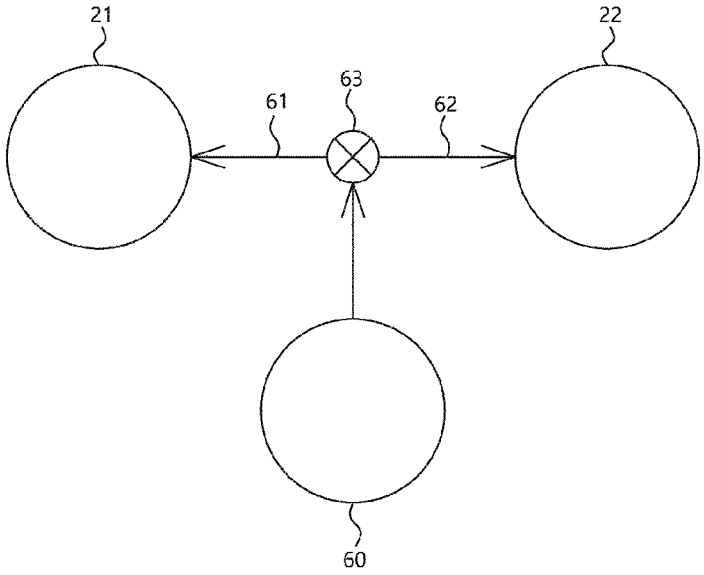

【Figure 6】
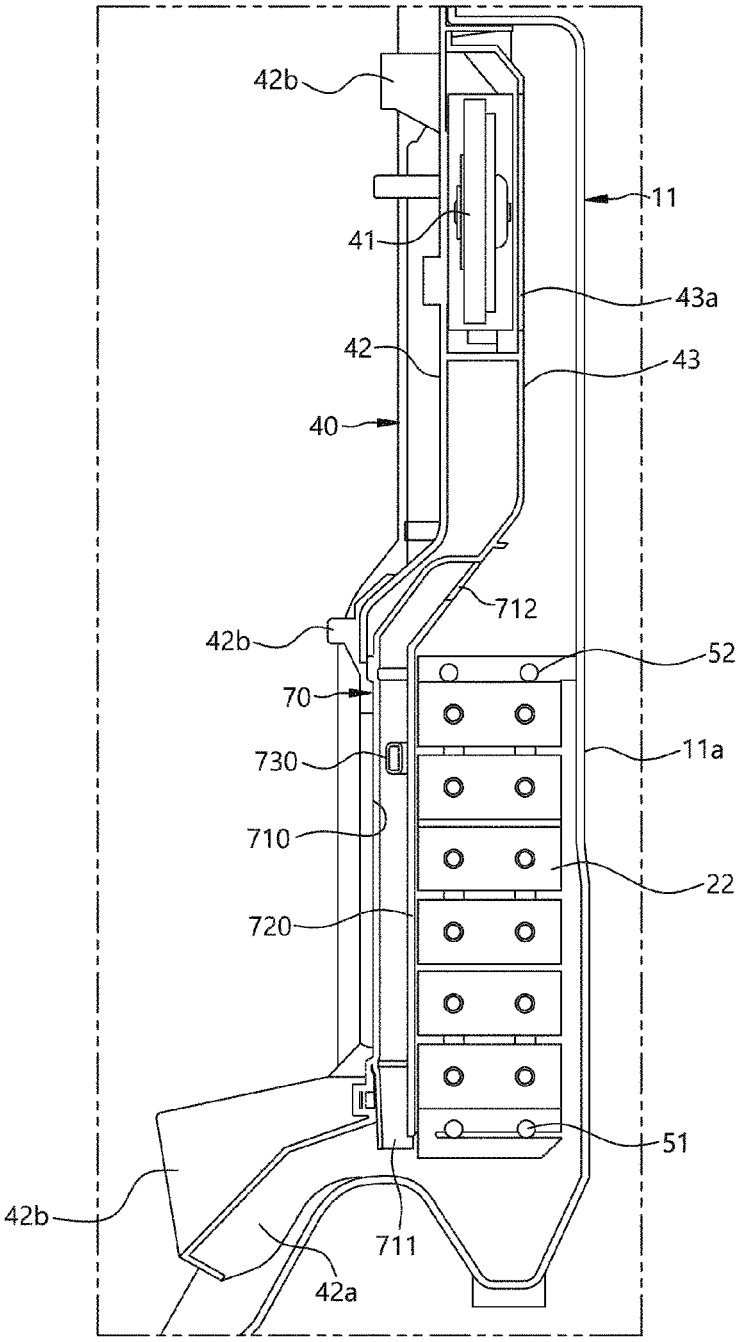

【Figure 7】
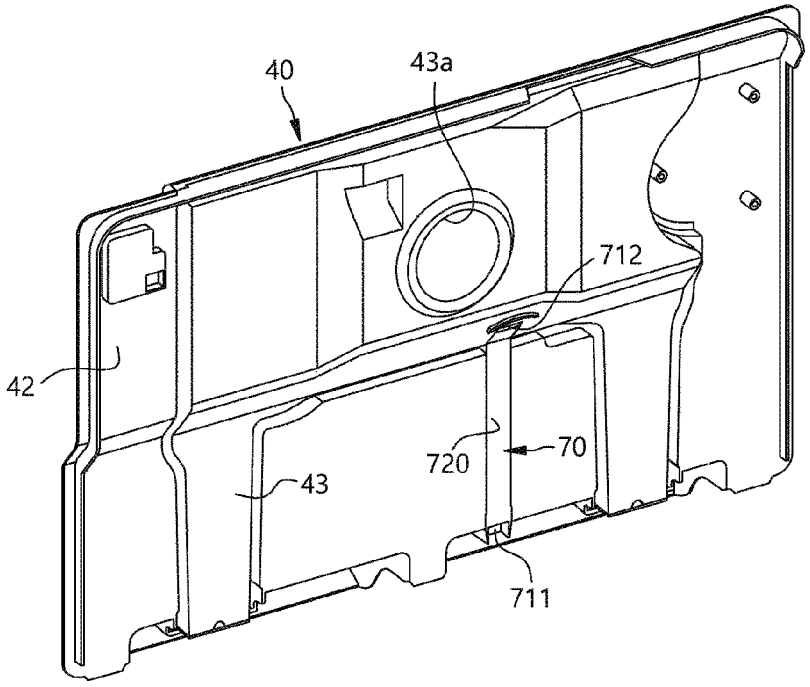

【Figure 8】
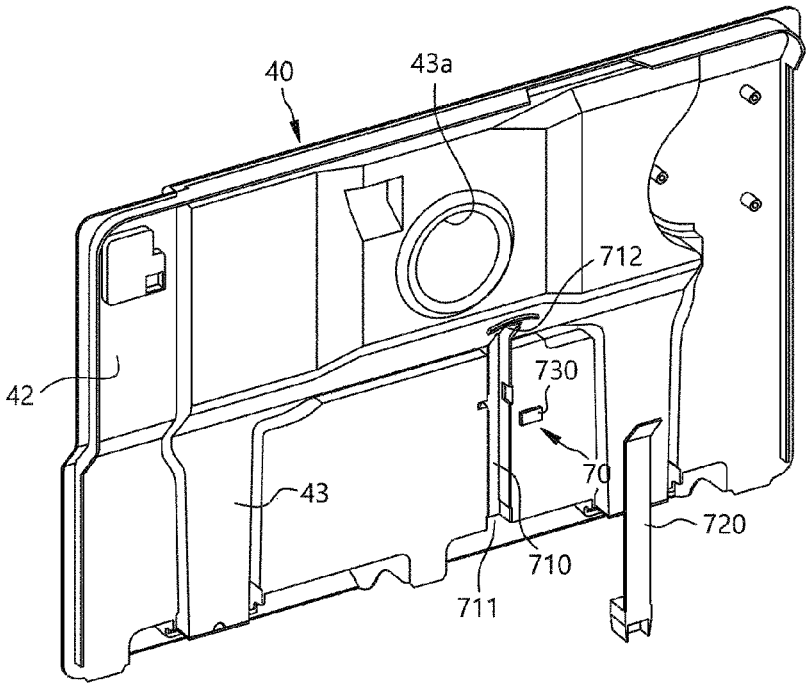

【Figure 9】
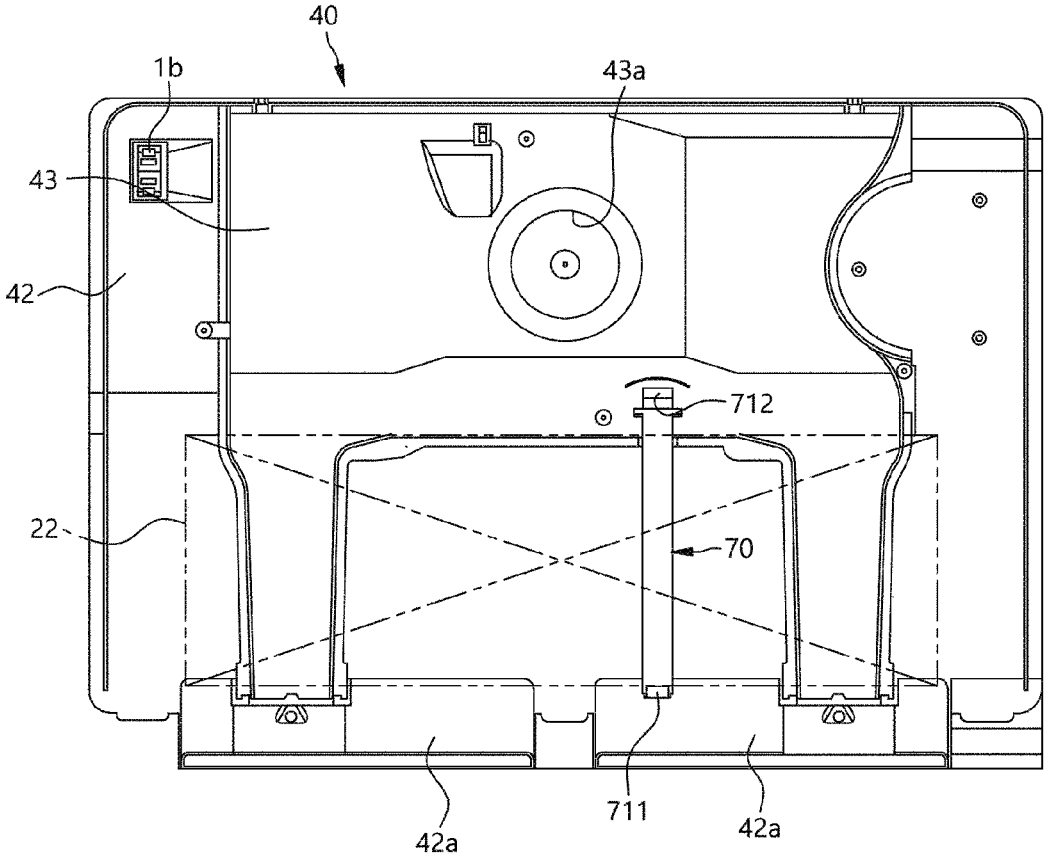

【Figure 10】
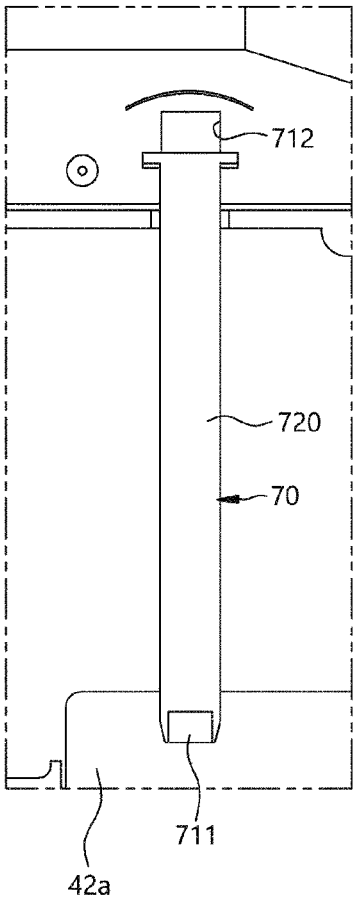

【Figure 11】
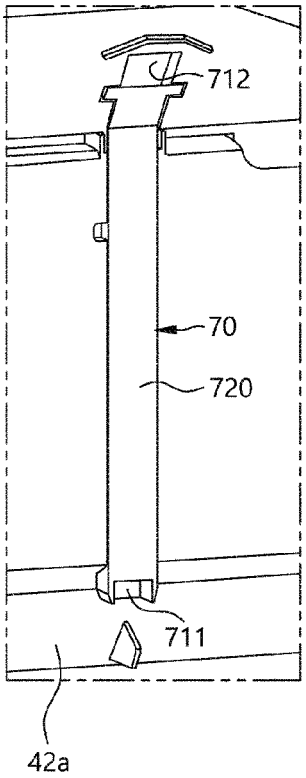

【Figure 12】
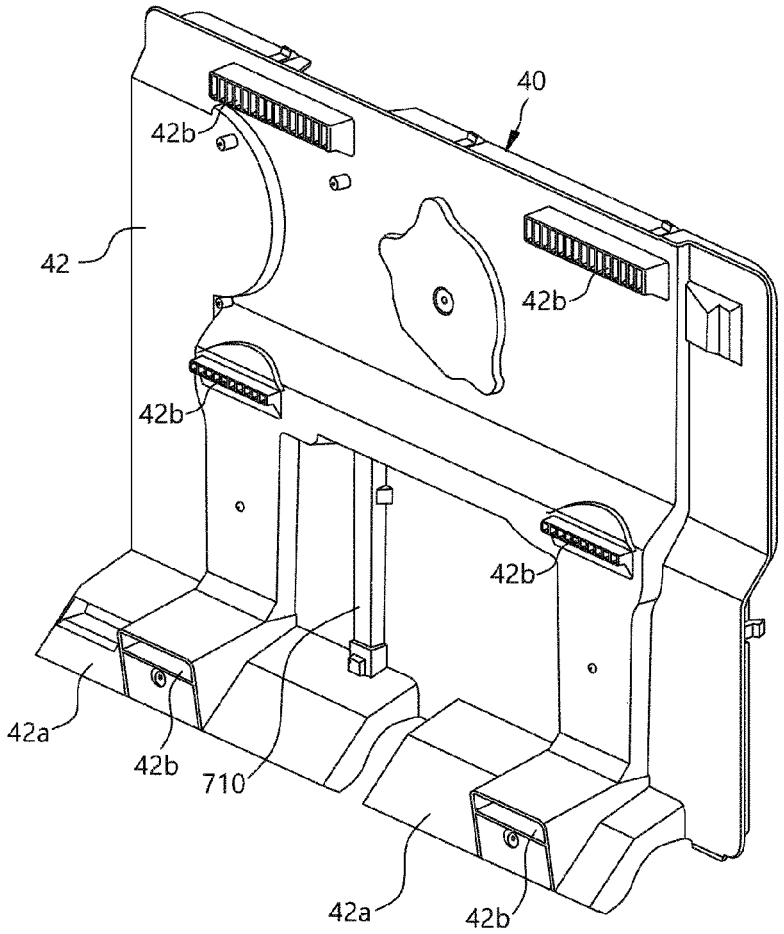

【Figure 13】
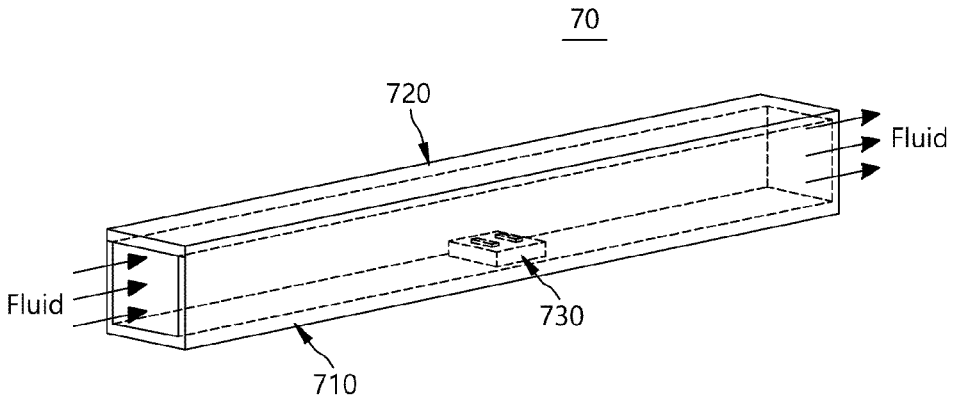
【Figure 14】
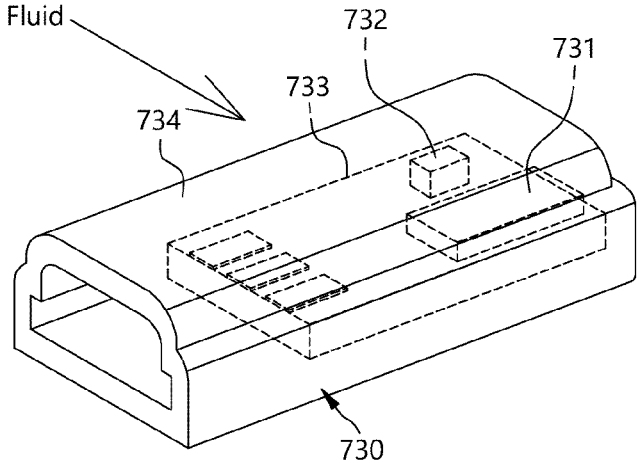

【Figure 15】
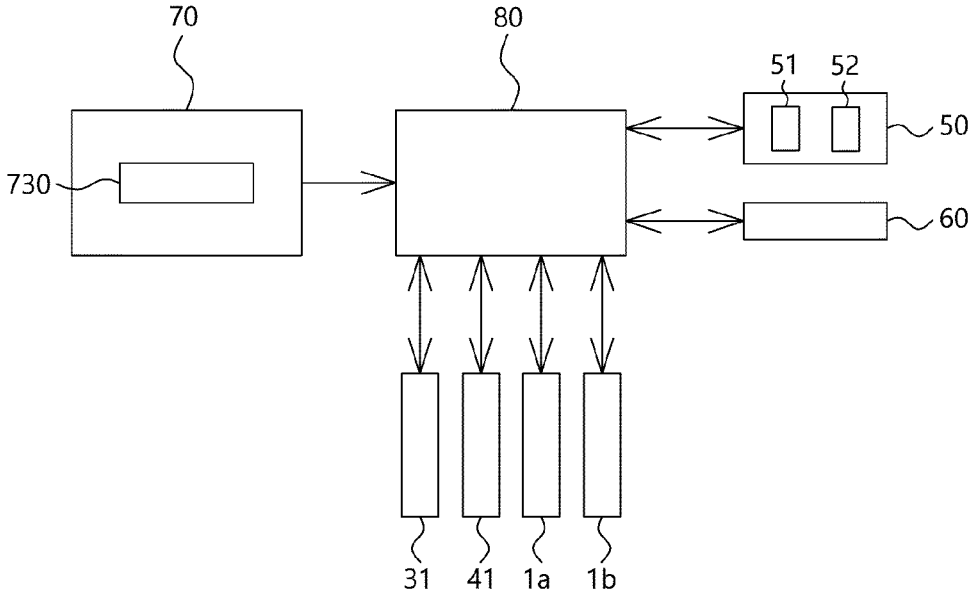
【Figure 16】
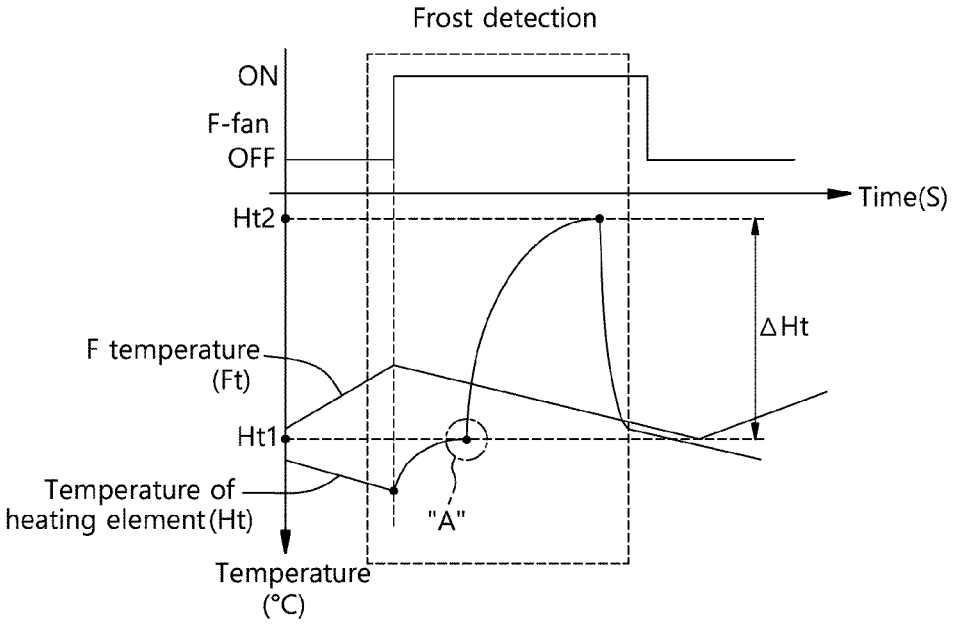

【Figure 17】
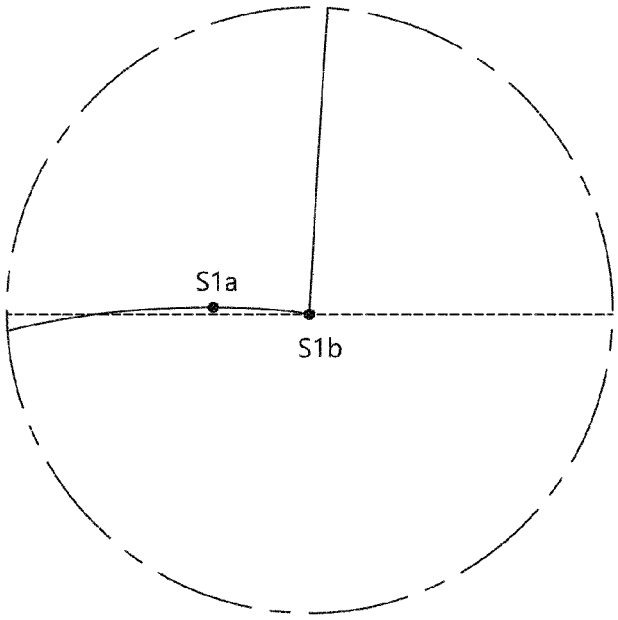

【Figure 18】
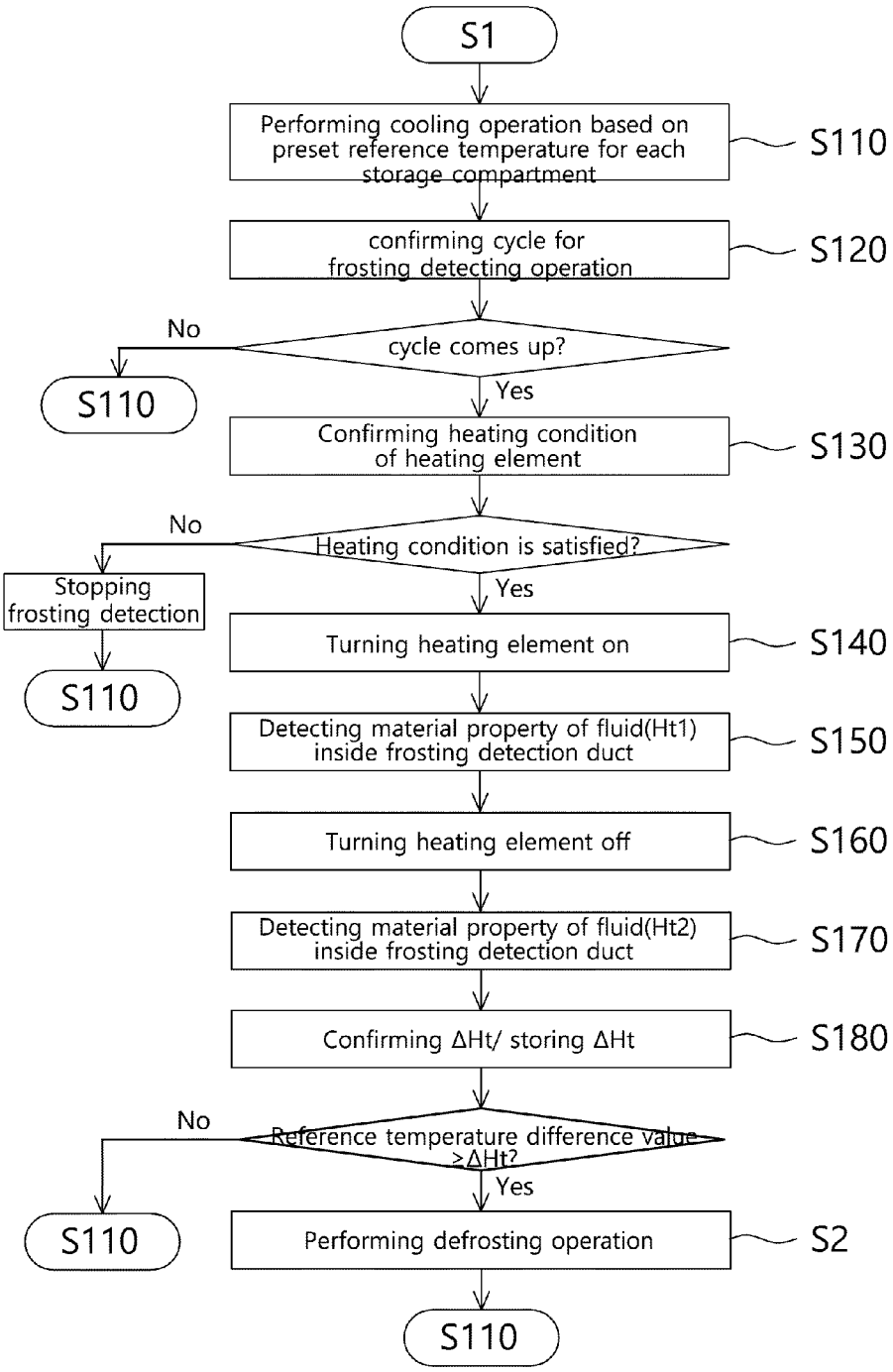

【Figure 19】
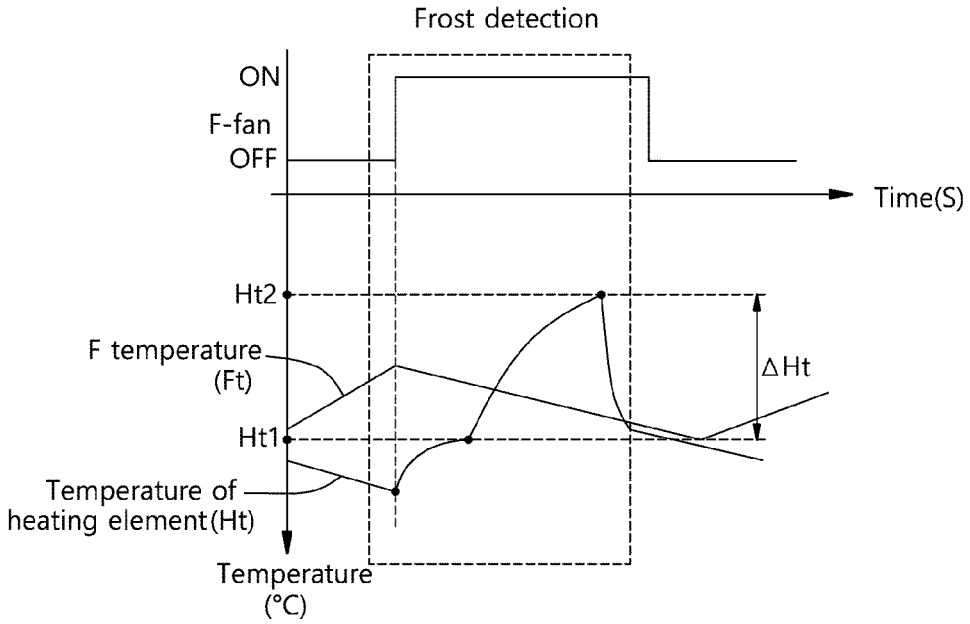

REFRIGERATOR

CROSS-REFERENCE TO RELATED APPLICATION

This application is the National Stage filing under 35 U.S.C. 371 of International Application No. PCT/KR2021/009252, filed Jul. 19, 2021, which claims priority to and the benefit of KR Patent Application No. 10-2020-0098359, filed Aug. 6, 2020, the disclosure of which is incorporated herein by reference in its entirety.

TECHNICAL FIELD

The present disclosure relates to a refrigerator that is configured to perform frosting detection with respect to a cooling source in consideration of cooling environment variable depending on what a user needs.

BACKGROUND

In general, a refrigerator is an appliance that uses cold air to store objects in a storage space for a long time while maintaining at a constant temperature.

The refrigerator includes a refrigeration system including one or more evaporators to generate and circulate the cold air.

Herein, the evaporator serves to maintain internal air of the refrigerator within a preset temperature range by exchanging heat between a low-temperature and low-pressure refrigerant with the internal air of the refrigerator (cold air circulating inside the refrigerator).

Frost is generated on a surface of the evaporator due to water or humidity contained in the internal air of the refrigerator or moisture existing around the evaporator during heat exchange with the internal air of the refrigerator.

Conventionally, when a certain time elapses after the operation of the refrigerator started, a defrosting operation is performed to remove frost generated on the surface of the evaporator.

In other words, conventionally, the defrosting operation is performed through indirect estimation based on the operation time, rather than directly detecting the amount of frost generated on the surface of the evaporator.

Accordingly, conventionally, the defrosting operation is performed even though the frosting is not generated, and thus, there are problems in that power consumption efficiency is reduced or the defrosting operation is not performed despite excessive frosting.

Specifically, the defrosting operation is performed by allowing a heater to emit heat and raise the temperature around the evaporator so that defrosting is performed. After the defrosting operation is performed as described above, a large load operation is performed so that the internal temperature of the refrigerator quickly reaches a preset temperature, resulting in large power consumption.

Accordingly, conventionally, various studies have been made to shorten the time for the defrosting operation or the cycle of the defrosting operation.

In recent years, in order to accurately detect the amount of frosting on the surface of the evaporator, a method using temperature difference or pressure difference between an inlet side and an outlet side of the evaporator has been proposed, and the method was disclosed in Korean Patent Application Publication No. 10-2019-0101669, Korean Patent Application Publication No. 10-2019-0106201, Korean Patent Application Publication No. 10-2019-0106242, Korean Patent Application Publication No. 10-2019-0112482, Korean Patent Application Publication No. 10-2019-0112464, etc.

The above documents describe technique to form a bypass flow path, which has a separate flow from an air flow passing through the evaporator, to a cold air duct, and to measure a temperature difference changed in response to a difference of the amount of air passing through the bypass flow path to precisely determine the start time of the defrosting operation.

However, the documents do not consider the cooling operation for a refrigerating compartment, so that a condition measurement of the evaporator cannot precisely performed, and power consumption efficiency may be deteriorated.

Specifically, in case of recent refrigerators, a freezing system that is configured to selectively operate two or more evaporators with one compressor is provided, and in the freezing system, when the evaporator for the cooling operation is operated, cold air does not flow to other evaporator for a freezing operation.

In other words, when a fan assembly located in the refrigerating compartment is operated, a fan assembly located in a freezing compartment is not operated.

Accordingly, the frosting detection method associated with the above does not consider an operation of the fan assembly located in the refrigerating compartment, so that there is a problem in that it is difficult to precisely recognize a temperature change of an evaporator located at the freezing compartment side, and there is a limit to improving the power consumption efficiency.

Furthermore, in recent years, during operation considering the internal temperature of the refrigerator or the temperature set by the user, an operation cycle for supplying cold air to the refrigerating compartment is controlled to be shortened to improve power consumption efficiency.

However, in proportion to the shortening of the operating cycle of the refrigerating compartment, an operating cycle or operating time of the freezing compartment-side fan assembly is inevitably shortened. However, the documents described above do not consider the internal temperature or the set temperature of the user, so a measurement error for the temperature change in the bypass flow path occurs.

Specifically, in the techniques above, despite existence of the measurement error, the operation considering the measurement error is not performed, so the measurement reliability for the frosting is inevitably low, and thus a technique supplementing the above problem is required.

SUMMARY

Accordingly, the present disclosure has been made keeping in mind the various problems, and the present disclosure is intended to achieve frosting detection of an evaporator in consideration of a cold air operation by the internal environment or the temperature set by a user.

One aspect of the present disclosure is to reduce an error during a frost detecting operation and improve the measurement reliability for frosting by allowing a heating time of the heating element to be shorter than a remaining operation time of a second cooling fan.

Another aspect of the present disclosure is to reduce power consumption when the frost detecting operation stops or an error occurs.

Yet another aspect of the present disclosure is to maximize the discrimination of a logic temperature $\Delta Ht$ so that a defrosting operation is performed when the defrosting operation is actually required.

In order to achieve this, a refrigerator of the present disclosure may be provided with the following solution.

A controller constituting the refrigerator of the present disclosure may control a frost detecting device to perform frost detecting operation for a preset frost detecting time. Accordingly, the frosting detection may be performed during an operation at constant temperature.

The controller constituting the refrigerator of the present disclosure may control the frost detecting operation to be differently performed on the basis of at least one of a room temperature and a set reference temperature. Accordingly, more precise frosting detection may be performed.

The controller constituting the refrigerator of the present disclosure may perform control such that when an internal temperature of a storage compartment is within a dissatisfaction temperature region divided on the basis of the set reference temperature of a user, the amount of cold air supply may increase. Accordingly, the internal temperature may be maintained at the set reference temperature.

The controller constituting the refrigerator of the present disclosure may perform control such that when the internal temperature of the storage compartment is within a satisfaction temperature region divided on the basis of the set reference temperature of the user, the amount of cold air supply may be reduced. Accordingly, the internal temperature may be maintained at the set reference temperature and the power consumption may be reduced.

A frost detecting device constituting the refrigerator of the present disclosure may include a frosting sensor to measure a material property of a fluid passing through a frosting detection flow path. Accordingly, the frost detecting device may measure a temperature difference value (logic temperature, ΔHt) in response to the flow amount of the fluid flowing in the flow path.

At least a part of the frosting detection flow path of the refrigerator of the present disclosure may be disposed in a flow path formed between a first duct and a cooling source. Accordingly, a fluid entering the first duct and flowing to the cooling source may partially enter the frosting detection flow path.

At least a part of the frosting detection flow path of the refrigerator of the present disclosure may be disposed in a flow path formed between a second duct and the storage compartment. Accordingly, the fluid passing through the frosting detection flow path may flow into the storage compartment via the second duct.

A frosting sensor constituting the refrigerator of the present disclosure may include a detecting derivative. Accordingly, the improvement in the precision when the material property is measured may be induced.

The detecting derivative constituting the refrigerator of the present disclosure may include a heating element that generates heat. Accordingly, a temperature difference value according to the flow amount of fluid may be checked.

The refrigerator of the present disclosure may include a refrigerant valve. Accordingly, the amount of a refrigerant supplied to an evaporator may be adjusted.

The controller constituting the refrigerator of the present disclosure may control the frost detecting time to vary in response to a temperature value of the room temperature. Accordingly, an error occurring in the frosting detection may be reduced.

The controller constituting the refrigerator of the present disclosure may perform control such that the frost detecting time within a temperature range in which a temperature value of the room temperature is high is performed shorter than the frost detecting time within a temperature range in which a temperature value of the room temperature is low. Accordingly, an error occurring in the frosting detection may be reduced.

The controller constituting the refrigerator of the present disclosure may control the frost detecting time to vary on the basis of the set reference temperature. Accordingly, an error occurring in the frosting detection may be reduced.

The controller constituting the refrigerator of the present disclosure may perform control such that the frost detecting time within the temperature region in which the set reference temperature is high is performed shorter than the frost detecting time within the temperature region in which the set reference temperature is low. Accordingly, an error occurring in the frosting detection may be reduced.

The controller constituting the refrigerator of the present disclosure may stop the frost detecting operation when detecting opening of a door during the frost detecting operation. Accordingly, an error occurring in the frosting detection may be reduced and power consumption may be prevented.

The controller constituting the refrigerator of the present disclosure may stop the frost detecting operation when the cooling fan is turned off during the frost detecting operation. Accordingly, an error occurring in the frosting detection may be reduced and power consumption may be prevented.

The refrigerator of the present disclosure may measure a material property of the fluid inside the frosting detection flow path by the frosting sensor after the heating element is turned on and off. Accordingly, it may be determined whether or not frost or ice is generated on the cooling source.

The refrigerator of the present disclosure may include determining a heating condition for turning on of the heating element. Accordingly, when the heating condition is satisfied, the heating element may be turned on, and thus power consumption may be reduced, and information with low reliability is not obtained so measurement reliability may be improved.

The storage compartment constituting the refrigerator of the present disclosure may include two or more storage compartments that may be maintained at difference temperatures.

The refrigerator of the present disclosure may include a first storage compartment maintained at a first set reference temperature.

The refrigerator of the present disclosure may include a second storage compartment that may be maintained at a second set reference temperature lower than the first set reference temperature.

The refrigerator of the present disclosure may be configured such that the first operational reference value of the first storage compartment may be set to be less than the second operational reference value of the second storage compartment.

The refrigerator of the present disclosure may control the frost detecting time to be shorter than an operation time of a second cooling fan. Accordingly, an error generated when the second cooling fan stops early during frosting detection may be prevented in advance.

The refrigerator of the present disclosure may be controlled such that the amount of cold air supplied by at least one of a first evaporator and a first cooling fan may be adjusted on the basis of a temperature value measured by at least any one of the first temperature sensor and the second temperature sensor. Accordingly, the temperature of the storage compartment may be precisely controlled.

The refrigerator of the present disclosure may be controlled such that the first cooling fan may be operated when the temperature of the first storage compartment is within the dissatisfaction temperature region divided on the basis of the set reference temperature. Accordingly, when the set reference temperature is not reached, the amount of cold air supply may increase.

The refrigerator of the present disclosure may be controlled such that after the temperature of the first storage compartment reaches a lower limit temperature value (NT-DIFF) of the first operational reference value a first refrigerant path is closed.

The refrigerator of the present disclosure may be controlled such that after the temperature of the first storage compartment reaches the lower limit temperature value (NT-DIFF) of the first operational reference value a second refrigerant path is opened.

Accordingly, even when refrigerant supply to the first evaporator stops, sufficient cold air may be supplied to the first storage compartment.

The refrigerator of the present disclosure may be controlled such that after the temperature of the first storage compartment reaches the lower limit temperature value (NT-DIFF) of the first operational reference value the first cooling fan may be operated for a constant time. Accordingly, even when the refrigerant supply to the evaporator stops, sufficient cold air may be supplied to the first storage compartment.

The refrigerator of the present disclosure may be controlled such that before the temperature of the first storage compartment reaches an upper limit temperature value (NT+DIFF) of the first operational reference value the first refrigerant path is opened.

The refrigerator of the present disclosure may be controlled such before the temperature of the first storage compartment reaches an upper limit temperature value (NT+DIFF) of the first operational reference value the second refrigerant path is closed. Accordingly, before the temperature of the first storage compartment reaches the upper limit temperature value (NT+DIFF) of the first operational reference value, cold air may be supplied.

As described above, the refrigerator of the present disclosure is configured to perform the frost detecting operation to confirm frosting of the second evaporator in consideration of the internal environment of the first storage compartment or the second storage compartment or the cold air operation in response to the temperature set by the user. Accordingly, the frosting detection may be precisely performed.

The refrigerator of the present disclosure is configured to reduce an error during the frost detecting operation as a heating time of the heating element is set shorter than a remaining operation time of the second cooling fan, and the measurement reliability for frosting may be improved.

Since it is determined that the heating condition is satisfied when the heating time of the heating element is further shorter than the remaining operation time of the second cooling fan, when the heating condition is not satisfied, the heating element does not emit heat and the power consumption may be reduced.

In the refrigerator of the present disclosure, it is possible to perform the precise frosting detection as the condition maximizing the discrimination of the logic temperature $\Delta Ht$ is applied as the heating condition for heat-emission of the heating element, and the defrosting operation performed based on the condition may be also performed when exactly necessary so that the consumption efficiency may be further improved.

DESCRIPTION OF DRAWINGS

FIG. 1 is a front view schematically showing an internal structure of a refrigerator according to an embodiment of the present disclosure.

FIG. 2 is a longitudinal-sectional view schematically showing a structure of the refrigerator according to the embodiment of the present disclosure.

FIG. 3 is a state view schematically showing an operational state performed on the basis of a user set reference temperature with respect to each storage compartment of the refrigerator according to the embodiment of the present disclosure.

FIG. 4 is a view schematically showing a structure of a thermoelectric module according to the embodiment of the present disclosure.

FIG. 5 is a block diagram schematically showing a refrigerating cycle of the refrigerator according to the embodiment of the present disclosure.

FIG. 6 is a main part sectional view showing a space behind a second storage compartment inside a casing in order to describe installation of a frost detecting device and an evaporator that constitute the refrigerator according to the embodiment of the present disclosure.

FIG. 7 is a rear-perspective view of a fan duct assembly used to describe installation of the frost detecting device constituting the refrigerator according to the embodiment of the present disclosure.

FIG. 8 is an exploded-perspective view showing the fan duct assembly without a flow path cover and a sensor of the refrigerator according to the embodiment of the present disclosure.

FIG. 9 is a rear view showing the fan duct assembly in order to describe installation of the frost detecting device constituting the refrigerator according to the embodiment of the present disclosure.

FIG. 10 is an enlarged view showing installation of the frost detecting device constituting the refrigerator according to the embodiment of the present disclosure.

FIG. 11 is an enlarged-perspective view showing installation of the frost detecting device constituting the refrigerator according to the embodiment of the present disclosure.

FIG. 12 is a front-perspective view showing the fan duct assembly constituting the refrigerator according to the embodiment of the present disclosure.

FIG. 13 is a main part enlarged view showing installation of the frost detecting device according to the embodiment of the present disclosure.

FIG. 14 is a view schematically showing a frosting sensor of the frost detecting device according to the embodiment of the present disclosure.

FIG. 15 is a block diagram schematically showing a control structure of the refrigerator according to the embodiment of the present disclosure.

FIG. 16 is a state graph showing temperature change in a frosting detection flow path in response to on/off of a heating element and on/off of each cooling fan right after defrosting with respect to the evaporator of the refrigerator terminates according to the embodiment of the present disclosure.

FIG. 17 is an enlarged view showing part "A" in FIG. 16.

FIG. 18 is a flowchart showing a control process performed by a controller in an event of frost detecting operation of the refrigerator according to the embodiment of the present disclosure.

FIG. 19 is a state graph showing temperature change in the frosting detection flow path in response to on/off of the heating element and on/off of the cooling fan while frosting to the evaporator of the refrigerator is in progress according to the embodiment of the present disclosure.

DETAILED DESCRIPTION

The present disclosure is configured to allow detection of frosting of an evaporator considering cooling operation based on internal environment or set reference temperature set by a user.

In other words, the present disclosure is configured to allow a frost detecting operation to be performed in cooling operation where two evaporator are operated with one compressor, in consideration of shorted operation cycle of two cooling fans, so that it may be possible to perform precise frosting detection and to minimize power consumption caused by frosting detection, and thereby improve power consumption efficiency.

As described above, preferred embodiments of a structure and an operational control of a refrigerator of the present disclosure will be described with reference to accompanying FIGS. 1 to 19.

FIG. 1 is a front view schematically showing an internal structure of a refrigerator according to an embodiment of the present disclosure. FIG. 2 is a longitudinal-sectional view schematically showing a structure of the refrigerator according to the embodiment of the present disclosure.

As shown in the drawings, according to the embodiment of the present disclosure, a refrigerator 1 may include a casing 11.

The casing 11 may include an outer casing 11*b* providing an exterior shape of the refrigerator 1.

Furthermore, the casing 11 may include an inner casing 11*a* providing an internal wall surface of the refrigerator 1. A storage compartment may be provided at the inner casing 11*a* to store stored objects.

The storage compartment may include one storage compartment or multiple storage compartments. In the embodiment of the present disclosure, it is illustrated that the storage compartment includes two storage compartments that respectively store stored objects at different temperatures.

The storage compartments may include a first storage compartment 12 maintained at a first set reference temperature.

The first set reference temperature may be a temperature at which stored objects do not freeze and also may be a temperature range lower than external temperature of the refrigerator 1 (room temperature).

For example, the first set reference temperature may be set at a temperature range that is less than or equal to 32° C. and higher than 0° C. Of course, when necessary (for example, according to the room temperature, a type of stored objects, or the like), the first set reference temperature may be set more higher than 32° C. or equal to or less than 0° C.

Specifically, the first set reference temperature may be an internal temperature of the first storage compartment 12 set by a user. However, when the user does not set the first set reference temperature, an arbitrary designated temperature may be used as the first set reference temperature.

The first storage compartment 12 may be configured to be operated at a first operational reference value so as to maintain the first set reference temperature.

The first operational reference value may be set at a temperature range value including a first lower limit temperature NT-DIFF1. For example, when the internal temperature of the first storage compartment 12 reaches the first lower limit temperature NT-DIFF1 on the basis of the first set reference temperature, an operation for supplying cold air stops.

The first operational reference value may be set at a temperature range value including a first upper limit temperature NT+DIFF1. For example, when the internal temperature rises on the basis of the first set reference temperature, the operation for cold air supply may be resumed before reaching the first upper limit temperature NT+DIFF1.

As described above, inside the first storage compartment 12, on the basis of the first set reference temperature, the supply of cold air is performed or interrupted in consideration of the first operational reference value with respect to the first storage compartment.

This set reference temperature NT and the operational reference value DIFF are as shown in accompanying FIG. 3.

Furthermore, the storage compartment may include a second storage compartment 13 maintained at a second set reference temperature.

The second set reference temperature may be a temperature lower than the first set reference temperature. At this point, the second set reference temperature may be set by the user, and when the user does not set the second set reference temperature, an arbitrary set temperature may be used as the second set reference temperature.

The second set reference temperature may be a temperature at which stored objects can freeze. For example, the second set reference temperature may be set at a temperature range that is less than or equal to 0° C. and equal to or higher than −24° C. Of course, when necessary (for example, according to the room temperature, a type of stored objects, or the like), the second set reference temperature may be set higher than 0° C. or less than or equal to −24° C.

Specifically, the second set reference temperature may be an internal temperature of the second storage compartment 13 set by the user. However, when the user does not set the second set reference temperature, an arbitrary designated temperature may be used as the second set reference temperature.

The second storage compartment 13 may be configured to be operated at a second operational reference value so as to maintain the second set reference temperature.

The second operational reference value may be set at a temperature range value including a second lower limit temperature NT-DIFF2. For example, when the internal temperature of the second storage compartment 13 reaches the second lower limit temperature NT-DIFF2 on the basis of the second set reference temperature, an operation for supplying cold air stops.

The second operational reference value may be set at a temperature range value including a second upper limit temperature NT+DIFF2. For example, when the internal temperature of the second storage compartment 13 rises on the basis of the second set reference temperature, the operation for cold air supply may be resumed before reaching the second upper limit temperature NT+DIFF2.

As described above, inside the second storage compartment 13, on the basis of the second set reference temperature, the supply of cold air is performed or interrupted considering the second operational reference value with respect to the second storage compartment.

The first operational reference value may be set with a temperature range between the upper limit temperature and the lower limit temperature smaller than the second operational reference value. for example, the second lower limit temperature NT-DIFF2 and the second upper limit temperature NT+DIFF2 of the second operational reference value may be set to ±2.0° C., and the first lower limit temperature NT-DIFF1 and the first upper limit temperature NT+DIFF1 of the first operational reference value may be set to ±1.5° C.

Meanwhile, the above-described storage compartment is configured to circulate a fluid and maintain the internal temperature of the storage compartment.

The fluid may be air. Also in the following description, it is illustrated that the fluid circulated in the storage compartment is air. Of course, the fluid may be a gas other than air.

The temperature outside the storage compartment (the room temperature) may be measured by a first temperature sensor 1*a* as shown in FIG. 15, and the internal temperature of the storage compartment may be measured by a second temperature sensor 1*b* (referring to FIG. 9).

The first temperature sensor 1*a* and the second temperature sensor 1*b* may be separately provided. Of course, the room temperature and the internal temperature of the storage compartment may be measured by the same one temperature sensor or be measured by two or more multiple temperature sensors that cooperate.

Furthermore, the storage compartment 12, 13 may include a door 12*b*, 13*b*.

The door 12*b*, 13*b* serves to open and close the storage compartment 12, 13, and may have a rotatable opening and closing structure, or may have a drawer-type opening and closing structure.

The door 12*b*, 13*b* may include one or multiple doors.

Next, according to the embodiment of the present disclosure, the refrigerator 1 includes a cooling source.

The cooling source may include a structure that generates cold air.

The structure that generates cold air of the cooling source may be configured variously.

For example, the cooling source may include a thermoelectric module 23.

As shown in FIG. 4, the thermoelectric module 23 may include a thermoelement 23*a* including an endothermic surface 231 and an exothermic surface 232. The thermoelectric module 23 may comprise of a module including a sink 23*b* connected to at least one of the endothermic surface 231 and the exothermic surface 232 of the thermoelement 23*a*.

According to the embodiment of the present disclosure, the structure that generates cold air of the cooling source comprises an evaporator 21, 22.

The evaporator 21, 22 may constitute the refrigerating system together with a compressor 60 (referring to FIG. 5), and serve to perform heat exchange with air passing through the evaporator and lower the temperature of the air.

When the storage compartment includes the first storage compartment 12 and the second storage compartment 13, the evaporator may include a first evaporator 21 and a second evaporator 22, and the first evaporator 21 may supply cold air to the first storage compartment 12 and the second evaporator 22 may supply cold air to the second storage compartment 13.

At this point, inside the inside space of the inner casing 11*a*, the first evaporator 21 may be located at a rear side in the first storage compartment 12, and the second evaporator 22 may be located at a rear side in the second storage compartment 13.

Of course, although not shown in the drawing, one evaporator may be provided only in at least one of the first storage compartment 12 and the second storage compartment 13.

Even when two evaporators are provided, the one compressor 60 constituting the refrigerating cycle may be provided. In this case, as shown in FIG. 5, the compressor 60 may be connected to the first evaporator 21 so as to supply a refrigerant via a first refrigerant path 61, and may be connected to the second evaporator 22 so as to supply the refrigerant via a second refrigerant path 62. At this point, the refrigerant path 61, 62 may be selectively opened and closed using a refrigerant valve 63.

There is a structure that supplies the generated cold air to the storage compartment.

The cooling fan may be included as the structure that supplies the cold air of the cooling source. The cooling fan may serve to supply the cold air into the storage compartment 12, 13, the cold air being generated while passing through the cooling source.

At this point, the cooling fan may include a first cooling fan 31 that supplies the cold air generated while passing through the first evaporator 21, into the first storage compartment 12.

The cooling fan may include a second cooling fan 41 that supplies the cold air generated while passing through the second evaporator 22, into the second storage compartment 13.

Next, according to the embodiment of the present disclosure, the refrigerator 1 may include a first duct.

The first duct may be formed of at least one of a passage through which air passes (e.g., tube such as duct, pipe, or the like), a hole, and an air flow path. Air may flow from the inside space of the storage compartment to the cooling source by guidance of the first duct.

With reference to FIG. 6, the first duct may include an inlet duct 42*a*. In other words, a fluid flowing in the second storage compartment 13 by guidance of the inlet duct 42*a* may flow into the second evaporator 22.

The first duct may include a part of a bottom surface of the inner casing 11*a*. At this point, a part of the bottom surface of the inner casing 11*a* is a portion that is from a portion facing the bottom surface of the inlet duct 42*a* to a position to which the second evaporator 22 is mounted. Therefore, the first duct provides a flow path through which a fluid flows from the inlet duct 42*a* toward the second evaporator 22.

Next, according to the embodiment of the present disclosure, the refrigerator 1 may include the second duct.

The second duct may be formed of at least one of a passage that guides air around the evaporator 21, 22 constituting the cooling source so that the air flows into the storage compartment (e.g., tube such as duct, pipe, or the like), a hole, and a flow path of air.

The second duct may include a fan duct assembly 30, 40 that is located at front of the evaporator 21, 22.

As shown in FIGS. 1 and 2, the fan duct assembly 30, 40 may include at least one of a first fan duct assembly 30 and a second fan duct assembly 40, and the first fan duct assembly 30 guides cold air so that the cold air flows into the first storage compartment 12, and the second fan duct assembly 40 guides cold air so that the cold air flows into the second storage compartment 13.

At this point, a space between the fan duct assembly 30, 40 of the inside space of the inner casing 11*a* where the evaporator 21, 22 is located and a rear wall surface of the inner casing 11*a* may be defined as a heat-exchange flow path where air exchanges heat with the evaporator 21, 22.

Of course, although not shown in the drawings, even when a evaporator is provided only at one of the storage compartments, the fan duct assembly 30, 40 may be provided at each storage compartment 12, 13. And even when the evaporator 21, 22 is provided to each storage compartment 12, 13, only one fan duct assembly 30, 40 may be provided. Various configurations are possible.

Meanwhile, in the embodiment descried below, it is illustrated that a structure that generates cold air of the cooling source is the second evaporator 22, and a structure that supplies the cold air of the cooling source is the second cooling fan 41, and the first duct is a the inlet duct 42*a* formed in the second fan duct assembly 40, and the second duct is the second fan duct assembly 40.

As shown in FIGS. 7 to 9, the second fan duct assembly 40 may include a fan grille 42.

The inlet duct 42*a* may be formed in the fan grille 42 to suction air from the second storage compartment 13. The inlet duct 42*a* may be formed at each of opposite ends of a lower portion of the fan grille 42, and is configured to guide a suctioned flow of air that flows along an inclined corner portion, which is inclined due to a machine chamber, between a bottom surface and the rear wall surface in the inner casing 11*a*.

At this point, the inlet duct 42*a* may be used as a partial structure of the above-described first duct. In other words, the inlet duct 42*a* allows a fluid inside the second storage compartment 13 to flow into the cooling source (second evaporator 22).

Furthermore, as shown in FIGS. 7 to 9, the second fan duct assembly 40 may include a shroud 43.

The shroud 43 may be coupled to a rear surface of the fan grille 42. Accordingly, a flow path for guiding a flow of cold air into the second storage compartment 13 may be provided between the shroud 43 and the fan grille 42.

A fluid inlet 43*a* may be formed on the shroud 43. In other words, cold air passing through the second evaporator 22 flows into the flow path between the fan grille 42 and the shroud 43 via the fluid inlet 43*a* and then passes through each cold air outlet 42*b* of the fan grille 42 by guidance of the flow path, so that the cold air is discharged to the second storage compartment 13.

The cold air outlet 42*b* may include two or more multiple cold air outlets 42*b*. For example, as shown in FIG. 12, the cold air outlets 42*b* may be respectively formed at opposite side portions of an upper portion, opposite side portions of an intermediate portion, and opposite side portions of a lower portion of the grille fan 42.

The second evaporator 22 may be provided to be located at a lower position than the fluid inlet 43*a*.

Meanwhile, the second cooling fan 41 may be installed in the flow path between the fan grille 42 and the shroud 43.

Preferably, the second cooling fan 41 may be installed in the fluid inlet 43*a* formed in the shroud 43. In other words, by operation of the second cooling fan 41, air inside the second storage compartment 13 may pass successively through the inlet duct 42*a* and the second evaporator 22 and then may flow into the flow path via the fluid inlet 43*a*.

Next, according to the embodiment of the present disclosure, the refrigerator 1 may include a frost detecting device 70.

The frost detecting device 70 is a device that detects the amount of frost or ice generated on the cooling source.

FIG. 6 is a main part sectional view showing an installed state of the frost detecting device and the evaporator according to the embodiment of the present disclosure. FIGS. 7 to 11 are views showing installed state of the frost detecting device in the second fan duct assembly.

As in the embodiment shown in the drawings, the frost detecting device of according to the embodiment of the present disclosure is a divide that is located on a flow path of a fluid guided to the second fan duct assembly 40 and detects frosting of the second evaporator 22.

Furthermore, the frost detecting device 70 may recognize a degree of frosting of the second evaporator 22 by using a sensor outputting different values in response to a fluid property. At this point, the fluid property may include at least one of temperature, pressure, and flux.

The frost detecting device 70 may be configured to precisely determine the execution time of defrosting operation on the basis of the degree of frosting recognized as described above.

As shown in FIG. 8, the frost detecting device 70 may include a frosting detection flow path 710.

The frosting detection flow path 710 may provide a flow passage (flow path) of air detected by a frosting sensor 730 in order to detect frosting of the second evaporator 22. The frosting detection flow path 710 may be provided as a portion where a frosting sensor 730 to detect frosting of the second evaporator 22 is located.

Specifically, the frosting detection flow path 710 may be configured to provide a flow path divided from a flow of air passing through the second evaporator 22 and a flow of air flowing in the second fan duct assembly 40.

Furthermore, at least a part of the frosting detection flow path 710 may be located at least at any one portion in a flow path of cold air circulated in the second storage compartment 13, the inlet duct 42*a*, the second evaporator 22, and the second fan duct assembly 40.

Preferably, at least a part of the frosting detection flow path 710 may be arranged at an inlet flow path through which a fluid flows toward the cooling source while passing through the first duct.

For example, as shown in FIG. 9, the fluid inlet 711 of the frosting detection flow path 710 may be located to be open on a flow path through which a fluid flowing toward an air inlet side of the second evaporator (cooling source) 22 while passing through the inlet duct (first duct) 42*a*.

In other words, some of the air suctioned into the air inlet side of the second evaporator 22 through the inlet duct 42*a* may flow into the frosting detection flow path 710.

The fluid outlet 712 of the frosting detection flow path 710 may be located between an air outlet side of the second evaporator 22 and a flow path through which cold air is supplied to the second storage compartment 13.

Specifically, as shown in FIG. 9, the fluid outlet 712 of the frosting detection flow path 710 may be located to be open on a flow path through which a fluid flows toward the fluid inlet 43*a* of the shroud 43 while passing through the second evaporator 22.

In other words, air that passed through the frosting detection flow path 710 may flow between the air outlet side of the second evaporator 22 and the fluid inlet 43*a* of the shroud 43.

At this point, FIGS. 10 and 11 are views showing an installation state of the frost detecting device 70.

Meanwhile, as the amount of frosting on the second evaporator 22 increases and an air flow passing through the second evaporator 22 is gradually blocked, a pressure difference between the air inlet side and the air outlet side of the second evaporator 22 gradually becomes larger. The amount of air suctioned into the frosting detection flow path 710 gradually increases by the pressure difference.

As the volume of air suctioned into the frosting detection flow path 710 becomes larger, the temperature of a heating element 731 constituting the frosting sensor 730 described below falls, and a temperature difference value ΔHt in on/off of the heating element 731 (hereinbelow, which is referred to as "logic temperature") falls.

Considering this, as the logic temperature ΔHt inside the frosting detection flow path 710 becomes lower, the logic temperature being checked by the frosting sensor 730, the amount of frosting on the second evaporator 22 increases.

When there is no frost at the second evaporator 22 or a frosting amount is significantly less, most of the air passes through the second evaporator 22 in the heat-exchange space. On the other hand, some of the air may flow into the frosting detection flow path 710.

For example, based on a state in which frosting does not occur on the second evaporator 22, the frosting detection flow path 710 may be configured such that about 98% of the air suctioned via the inlet duct 42*a* passes through the second evaporator 22 and remaining of the air passes through the frosting detection flow path 710.

At this point, the volume of air passing through the second evaporator 22 and the frosting detection flow path 710 may gradually vary in response to the amount of frosting on the second evaporator 22.

For example, when frost is generated on the second evaporator 22, the volume of air passing through the second evaporator 22 is reduced. On the other hand, the volume of air passing through the frosting detection flow path 710 increases.

In other words, compared to the volume of air passing through the frosting detection flow path 710 before frosting of the second evaporator 22, the volume of air passing through the frosting detection flow path 710 in frosting of the second evaporator 22 significantly increases.

Specifically, it is desirable to configure the frosting detection flow path 710 such that change in the volume of air according to the amount of frosting on the second evaporator 22 may be at least doubled. In other words, in order to determine the amount of frosting using the volume of air, the volume of air before and after frosting should be changed by at least two times or more to obtain a detection value sufficient to have discrimination.

When the amount of frosting on the second evaporator 22 is large enough to require the defrosting operation, frost of the second evaporator 22 acts as a resistance of a flow path, so that the volume of the air flowing in the heat-exchange space of the evaporator 22 is reduced and the volume of the air flowing in the frosting detection flow path 710 increases.

As described above, the flux of the air flowing in the frosting detection flow path 710 varies according to the amount of frosting on the second evaporator 22.

The frosting detection flow path 710 is formed by recessing a facing surface to a surface of the fan grille 42 constituting the second fan duct assembly 40, the surface facing the second evaporator 22, thereby allowing air to flow into the frosting detection flow path 710.

At this point, the portion facing the second evaporator 22, i.e., a rear surface of the frosting detection flow path 710, is formed open, and the open rear surface is closed by a flow path cover 720.

Of course, although not shown in the drawings, the frosting detection flow path 710 may be made separate from the fan grille 42, and the frosting detection flow path 710 may be fixed (attached or coupled) to the fan grille 42 or provided at the shroud 43.

Furthermore, the frost detecting device 70 may include the frosting sensor 730.

The frosting sensor 730 is a sensor that detects a material property of a fluid passing through inside of the frosting detection flow path 710. At this point, the fluid property may include at least one of temperature, pressure, and flux.

Specifically, the frosting sensor 730 may be configured to calculate the amount of frosting on the second evaporator 22 on the basis of a difference in an output value that is changed according to the material property of the air (fluid) passing through inside the frosting detection flow path 710.

In other words, the amount of frosting on the second evaporator 22 is calculated by a difference in the output value confirmed by the frosting sensor 730 to be used to determine whether the defrosting operation is required.

In the embodiment of the present disclosure, it is illustrated that the frosting sensor 730 is provided to detect the amount of frosting on the second evaporator 22 by using a difference in temperature according to the volume of the air passing through inside the frosting detection flow path 710.

In other words, as shown in FIG. 13, the frosting sensor 730 is provided at a portion where the fluid flows, inside the frosting detection flow path 710, so that the amount of frosting on the second evaporator 22 may be detected on the basis of the output value that changes according to a fluid flow inside the frosting detection flow path 710.

Of course, the output value may be variously determined as not only the above-described temperature difference, but also a pressure difference, other property difference, or the like.

As shown in FIG. 14, the frosting sensor 730 may include a detecting derivative.

The detecting derivative may provide for induced improvement of measurement precision so that the sensor may further precisely measure a material property (or output value).

In the embodiment of the present disclosure, it is illustrated that the detecting derivative comprises the heating element 731.

The heating element 731 is supplied with power and emits heat.

As shown in FIG. 14, the frosting sensor 730 may include a temperature sensor 732.

The temperature sensor 732 measures the temperature around the heating element 731.

In other words, considering that the temperature around the heating element 731 varies according to the volume of the air passing through the heating element 731 while passing through inside the frosting detection flow path 710, the temperature sensor 732 measures a change in temperature and then the degree of frosting on the second evaporator 22 is calculated on the basis of the change in temperature.

As shown in FIG. 14, according to the embodiment of the present disclosure, the frosting sensor 730 may include a sensor printed circuit board (PCB) 733.

The sensor PCB 733 is configured to determine a difference between the temperature detected by the temperature sensor 732 in an OFF state of the heating element and the temperature detected by the temperature sensor 732 in an ON state of the heating element 731.

Of course, the sensor PCB 733 may be configured to determine whether the logic temperature ΔHt is less than or equal to a reference difference value.

For example, when the amount of frosting on the second evaporator 22 is less, a flux of the air passing through inside the frosting detection flow path 710 is less, and in this case, heat generated due to the heat state of the heating element 731 is cooled relatively low by the above-described flowing air.

Accordingly, the temperature detected by the temperature sensor 732 is high, and the logic temperature ΔHt is also high.

On the other hand, when the amount of frosting on the second evaporator 22 is large, a flux of the air passing through inside the frosting detection flow path 710 is large, and in this case, heat generated due to the ON state of the heating element 731 is cooled relatively more by the above-described flowing air.

Accordingly, the temperature detected by the temperature sensor 732 is low, and the logic temperature ΔHt is also low.

Therefore, the amount of frosting on the second evaporator 22 may be precisely determined according to high or low of the logic temperature ΔHt, and on the basis of the amount of frosting on the second evaporator 22 determined as described above, and the defrosting operation may be performed at the precise time.

In other words, when the logic temperature ΔHt is high, it is determined that the amount of frosting on the second evaporator 22 is less, and when the logic temperature ΔHt is low, it is determined that the amount of frosting on the second evaporator 22 is large.

Accordingly, the reference temperature difference value may be designated, and when the logic temperature ΔHt is lower than the designated reference temperature difference value, it may be determined that the defrosting operation of the second evaporator is required.

Meanwhile, the frosting sensor 730 is installed in a direction that crosses a direction of air passing through inside the frosting detection flow path 710, and a surface of the frosting sensor 730 and an inner surface of the frosting detection flow path 710 are located to be spaced apart from each other.

In other words, water may flow down through a gap between the frosting sensor 730 and the frosting detection flow path 710 that are spaced apart from each other.

At this point, a distance of the gap is preferably formed sufficient to prevent water from staying between the surface of the frosting sensor 730 and the inner surface of the frosting detection flow path 710.

It is preferable that the heating element 731 and the temperature sensor 732 may be located together on any one surface of the frosting sensor 730.

In other words, the heating element 731 and the temperature sensor 732 are located on the same surface, so that the temperature sensor 732 may precisely sense the change in temperature due to heat-emission of the heating element 731.

Furthermore, the frosting sensor 730 may be disposed between a fluid inlet 711 and a fluid outlet 712 of the frosting detection flow path 710, inside the frosting detection flow path 710.

Preferably, the frosting sensor 730 may be disposed at a position spaced apart from the fluid inlet 711 and the fluid outlet 712.

For example, the frosting sensor 730 may be disposed at an intermediate position inside the frosting detection flow path 710. The frosting sensor 730 may be disposed at a position inside the frosting detection flow path 710 relatively close to the fluid inlet 711 than the fluid outlet 712. Or, the frosting sensor 730 may be disposed at a position inside the frosting detection flow path 710 relatively closer to the fluid outlet 712 than the fluid inlet 711.

Furthermore, the frosting sensor 730 may include a sensor housing 734. The sensor housing 734 serves to prevent the water flowing down along the inside of the frosting detection flow path 710 from being brought into contact with the heating element, the temperature sensor 732, or the sensor PCB 733.

The sensor housing 734 may be formed such that any one of opposite ends thereof is open. Accordingly, a power wire (or signal wire) may be taken out of the sensor PCB 733.

Next, according to the embodiment of the present disclosure, the refrigerator 1 may include a defrosting device 50.

The defrosting device 50 is configured to provide a heat source to remove frost generated on the second evaporator 22. Of course, the defrosting device 50 may perform defrosting of the frost detecting device 70 or prevent ice formation.

As shown in FIG. 6, the defrosting device 50 may include a first heater 51. In other words, frost generated on the second evaporator 22 may be removed by heat-emission of the first heater 51.

The first heater 51 may be located at a lower portion of the second evaporator 22. In other words, the first heater 51 is configured such that heat may be supplied in the air flowing direction from a lower end of the second evaporator 22 to an upper end thereof.

Of course, although not shown in the drawing, the first heater 51 may be located at a lateral portion of the second evaporator 22, may be located at a front portion or a rear portion of the second evaporator 22, may be located at an upper portion of the second evaporator 22, or may be located to be brought into contact with the second evaporator 22.

The first heater 51 may comprise of a sheath heater. In other words, the first heater 51 may be configured such that frost generated on the second evaporator 22 is removed by using radiant heat and convective heat of the sheath heater.

Furthermore, as shown in FIG. 6, the defrosting device 50 may include a second heater 52.

The second heater 52 may emit heat at a lower output than the first heater 51 and supply the heat to the second evaporator 22.

The second heater 52 may be located to be in contact with the second evaporator 22. In other words, the second heater 52 is configured to remove frost generated on the second evaporator 22 by heat conduction while being directly in contact with the second evaporator 22.

As an example, the second heater 52 may comprise of an L-cord heater. In other words, the second heater may be configured to remove frost generated on the second evaporator 22 by conductive heat of the L-cord heater. The second heater 52 may be installed to be successively in contact with a heat-exchange fin located at the second evaporator 22.

The heater included in the defrosting device 50 may include both of the first heater 51 and the second heater 52, or may include only the first heater 51, or include only the second heater 52.

Meanwhile, the defrosting device 50 may include an evaporator temperature sensor.

The evaporator temperature sensor may detect the temperature around the defrosting device 50, and the detected temperature value may be used as a factor that determines ON/OFF of the heater 51, 52.

As an example, after the heater 51, 52 is turned ON, when the temperature value detected by the evaporator temperature sensor reaches a specific temperature (defrosting termination temperature), the heater 51, 52 may be turned OFF.

The defrosting termination temperature may be set as an initial temperature, and when remaining ice is detected on the second evaporator 22, the defrosting termination temperature may be raised by a predetermined temperature.

Next, according to the embodiment of the present disclosure, the refrigerator 1 may include a controller 80.

As shown in FIG. 15, the controller 80 may be a device that controls operation of the refrigerator 1. The controller may be microprocessor, an electrical logic circuit, etc.

For example, when the internal temperature of the storage compartment 12, 13 is within the dissatisfaction temperature region that is divided on the basis of the set reference temperature NT set for the storage compartment by the user, the controller 80 controls the amount of cold air supply to increase so that the internal temperature of the storage compartment may fall, and when the internal temperature of the storage compartment is within the satisfaction temperature region that is divided on the basis of the set reference temperature NT, the controller 80 may control the amount of cold air supply to be reduced.

Furthermore, the controller 80 may control the frost detecting device 70 to perform frost detecting operation.

To this end, the controller 80 may perform the frost detecting operation for a set frost detecting time.

At this point, the frost detecting time may be controlled to vary depending on a temperature value of the room temperature measured by the first temperature sensor.

In other words, it is considered that the room temperature may vary depending on the season, large or small change in the internal temperature due to opening and closing of the door may occur depending on the room temperature, and thus cooling operation is performed relative to the change.

For example, as the room temperature becomes higher, the frost detecting time may be controlled to be performed at short intervals due to more frequent cooling operation, and as the room temperature becomes lower, the frost detecting time may be controlled to be performed at sufficiently long intervals due to fewer cooling operations.

Preferably, a temperature value of the room temperature is divided into a high temperature region and a low temperature region and the controller may control the frost detecting time to be performed differently in response to the high and low temperature regions.

In other words, the controller may be configured to control the frost detecting time in the high temperature region in which a temperature value of the room temperature is high to be performed shorter than the frost detecting time in the low temperature region in which a temperature value of the room temperature is low.

At this point, the high temperature region may include a temperature region in which the room temperature is more higher than 32° C., and the low temperature region may include a temperature region in which the room temperature is more lower than 15° C.

As described above, the frost detecting time may vary in response to the room temperature.

Furthermore, the controller 80 may control the frost detecting operation to be performed differently on the basis of at least one of the room temperature and the set reference temperature by the user (when user does not set room temperature, which is set as basic temperature).

For example, the frost detecting time may be variously controlled in response to the above-described room temperature and the frost detecting time may be variously controlled by the set reference temperature that is set by the user to control the internal temperature of the storage compartment.

In other words, the controller 80 may control the frost detecting time in the high temperature region with the high set reference temperature to be performed shorter than the frost detecting time in the low temperature region with the low set reference temperature.

At this point, the high temperature region may include a temperature region in which the internal temperature is more higher than −16° C. and the low temperature region may include a temperature region in which the internal temperature is more lower than −24° C.

Furthermore, when door opening of the storage compartment is detected during the frost detecting operation, the controller 80 may stop the frost detecting operation.

In other words, considering that the second cooling fan 41 is set to stop operating when the door of the storage compartment 12, 13 is opened in the basic control of the refrigerator, when the door of the storage compartment 12, 13 is opened and the second cooling fan 41 stops operating, it may be preferable that the controller controls the frost detecting operation to stop.

Of course, even when the door are not opened, when the second cooling fan 41 is turned off, the frost detecting operation may stop.

Furthermore, the controller 80 may control the frosting sensor 730 to be operated for a predetermined cycle.

In other words, the heating element 731 of the frosting sensor 730 emits heat for a predetermined time by control of the controller 80, and the temperature sensor 732 of the frosting sensor 730 detects the temperature directly after the heating element 731 is turned ON and detects the temperature directly after the heating element 731 is turned OFF.

Therefore, after the heating element 731 is turned ON, the lowest temperature and the highest temperature may be checked and a temperature difference value between the lowest temperature and the highest temperature may be maximized, so that discrimination for frosting detection may be more enhanced.

Furthermore, the controller 80 may check a temperature difference value (logic temperature ΔHt) when the heating element 731 is turned ON and OFF, and may determine whether the maximum value of the logic temperature ΔHt is less than or equal to a first reference difference value.

At this point, the first reference difference value may be set as a value sufficient not to operate the defrosting operation.

Of course, the sensor PCB 733 constituting the frosting sensor 730 may be configured to perform checking the logic temperature ΔHt and comparing the logic temperature to the first reference difference value.

In this case, the controller 80 may be configured to receive the checking of the logic temperature ΔHt and the comparison result value with the first reference difference value that are performed by the sensor PCB 733 to control ON/OFF of the heating element 731.

Furthermore, when the defrosting operation terminates, the controller 80 may determine whether or not remaining ice on the second evaporator 22 exists.

In other words, the controller 80 performs defrosting on the basis of the logic temperature ΔHt, and when defrosting terminates, the controller 80 determines whether remaining ice on the second evaporator 22 exists.

However, even when defrosting terminates, when it is determined that remaining ice exists on the second evaporator 22, the controller 80 may execute the defrosting operation again or may execute post-defrosting operation earlier than the reference time.

Furthermore, the controller 80 may be configured to check a heating condition in controlling operation of the heating element 731.

In other words, when the heating condition of the heating element 731 is satisfied, the controller 80 may control the heating element 731 to emit heat.

As shown in FIGS. 16 and 17, the heating condition may include a condition in which rising of temperature in the frosting detection flow path 710 stops when power is supplied to the second cooling fan 41.

In other words, when the supply of power to the second cooling fan 41 is interrupted, normally, the temperature of the frosting sensor 730 gradually falls under the influence of the adjacent second evaporator 22.

In this state, when power is supplied to the second cooling fan 41 and the second cooling fan 41 is operated, the inside of the frosting detection flow path 710 is supplied with air suctioned from the internal space of the second storage compartment 13 that has relatively higher temperature than the temperature of the second evaporator 22, so that the temperature of the frosting detection flow path 710 is turned upward.

When normal supply of cold air is performed into the second storage compartment 13, the rising temperature is influenced by cold air inside the second storage compartment 13 from a predetermined time so that the temperature rising slows down, and continuous supply of cold air inside the second storage compartment 13 causes at time Sla in which rising of temperature stops.

As described above, the heating condition may include a temperature change (stop during temperature rising) in the frosting detection flow path 710 in a normal state as satisfying the heating condition. At this point, FIG. 17 is an enlarged view of part "A" in FIG. 16, and showing a time Sla in which rising of the temperature stops.

Furthermore, as shown in FIGS. 16 and 17, the heating condition may include a condition in which after temperature inside the frosting detection flow path 710 gradually rises due to the supply of power to the second cooling fan 41, the temperature is turned downward.

In other words, compared to the determination of the time when temperature inside the frosting detection flow path 710 stops rising, it is more efficient to determine when the temperature is turned downward. At this point, FIG. 17 is an enlarged view of part "A" in FIG. 16 and showing a time Sib in which the temperature is turned downward.

Furthermore, the heating condition may include a condition in which the temperature inside the second storage compartment 13 checked by a separate temperature sensor 1*b* that senses the temperature inside the second storage compartment 13 falls over a set range even by the supply of power to the second cooling fan 41.

For example, when the temperature inside the second storage compartment 13 is not sufficiently low or a hot stored object is inserted, or the temperature inside the second storage compartment 13 does not sufficiently fall even by the supply of power to the second cooling fan 41, in the defrosting detection operation, a changed value (temperature difference value) between ON-temperature and OFF-temperature of the heating element 731.

At this point, the set range may be an hourly falling temperature (e.g., −0.5° C. per 1 minute), or an hourly falling temperature range (e.g., temperatures less than or equal to −0.5° C. and less than 0° C. per 1 minute).

Considering this, the heating condition may be satisfied when the temperature inside the second storage compartment 13 falls by the set range in operation of the second cooling fan 41.

Furthermore, the heating condition may include a condition in which the temperature inside the second storage compartment 13 stops rising or falls.

For example, when external air flows into the second storage compartment 13 due to opening of the door or stored objects with relatively high temperature is inserted into the second storage compartment 13, the internal temperature of the second storage compartment 13 may temporarily increase. In this state, the internal temperature of the frosting detection flow path 710 measured by the temperature sensor 732 may be degraded in discriminating, thereby causing a measurement error.

Considering this, it may be preferable to determine that the heating condition is satisfied in the condition in which the internal temperature of the second storage compartment 13 stops rising or falls.

Of course, the heating condition may include a condition in which after power is supplied to the second cooling fan 41, the temperature of the second storage compartment 13 gradually falls by a predetermined range for a set time.

The predetermined range may be, for example, 0.5° C. per minute, may be 1.0° C. per 2 minutes, or may be 1.5° C. per 3 minutes. The heating condition may be set as a changed temperature per second (or, temperature range).

Furthermore, the heating condition may include a condition in which a heating time of the heating element 731 is shorter than a remaining operation time of the second cooling fan 41.

In other words, when the heating element 731 emits heat for a predetermined time or more (e.g., 3 minutes), the temperature rises sufficiently to generate the discrimination in temperature change. Accordingly, when the desired heating time of the heating element 731 is shorter than the remaining operation time of the second cooling fan 41, a temperature change value having the discrimination may not be obtained.

Considering this, it may be preferable to determine that the heating condition is satisfied when the heating time of the heating element 731 is shorter than the remaining operation time of the second cooling fan 41.

Specifically, a control logic of the remaining operation time of the second cooling fan 41 may be changed in response to an internal environment of the first storage compartment 12 or the second storage compartment 13, or a storage temperature of the first storage compartment 12 or the second storage compartment 13 that is set by a user.

For example, when the internal temperature of the first storage compartment 12 is set excessively low, the operation time of the first cooling fan 31 is relatively longer than the operation time of the first cooling fan 31 when the first cooling fan is operated within a normal temperature range, or the operational cycle is more shorter, and the operation time of the second cooling fan 41 is relatively shorter or the operational cycle is more shorter.

Accordingly, when the heating condition is determined, it may be preferable that the remaining operation time of the second cooling fan 41 is performed according to control considering the operation time of the second cooling fan 41 to which the internal environment or the temperature set by the user is applied.

At this point, the heating time of the heating element 731 may be shorter than the operation time of the second cooling fan 41 when the storage temperature is set at the lowest temperature that may be set by the user for the first storage compartment 12.

Conventionally, as the heating time of the heating element 731 does not consider the remaining operation time of the second cooling fan 41, during heat-emission of the heating element 731, the operation time of the second cooling fan 41 terminates and the second cooling fan 41 stops operating. Accordingly, a measurement error may occur and power consumption due to unnecessary heat-emission of the heating element 731 may result, but the above-described measurement error and power consumption may be prevented by the above-described heating condition.

Furthermore, the heating condition may include a condition in which the second cooling fan 41 is maintained at a middle speed or more.

In other words, when the second cooling fan 41 is operated at a sufficient speed that allows air to flow into the frosting detection flow path 710, it may be determined that the heating condition is satisfied.

Furthermore, the heating condition may include a condition in which the rotation speed of the second cooling fan 41 is maintained without change.

In other words, when the second cooling fan 41 continues to be operated for a predetermined time at equal speed, it may be determined that the heating condition is satisfied.

Meanwhile, the heating condition may include a basic condition.

For example, the basic heating condition may include a condition in which when a set time elapses after operation of the second cooling fan 41, the heating element 731 is controlled to automatically emit heat.

Of course, the set time may be the time for the heating element 731 may emit heat for a predetermined time within the remaining operation time of the second cooling fan 41.

Furthermore, the basic heating condition may include a condition in which before operation of the second cooling fan 41, the internal temperature of the frosting detection flow path (temperature checked by temperature sensor) gradually falls.

In other words, as described above, when the internal environment of the second storage compartment 13 or the peripheral environment of the second evaporator 22 is normal, in the stop state of the second cooling fan 41, the internal temperature of the frosting detection flow path 710 should gradually fall under the influence of the second evaporator 22 located adjacent to the frosting detection flow path 710.

However, when abnormal stored objects (for example, hot stored objects) are stored in the second storage compartment 13, even when the second cooling fan 41 is not operated, the temperature may continue to rise, and in this case, a difference between temperatures in the ON and OFF states of the heating element 731 is small, thereby lacking in the discrimination.

Accordingly, when the internal temperature of the frosting detection flow path 710 rises before operation of the second cooling fan 41, it may be determined that the heating condition is not satisfied. In this case, it may be preferable not to perform the control logic for frosting detection.

Furthermore, the basic heating condition may include a condition in which the second cooling fan 41 is in operation.

For example, when the first cooling fan 31 is operated, the operation of the second cooling fan 41 stops, and when the operation of the second cooling fan 41 stops, it may be determined that the heating condition is not satisfied.

Furthermore, the basic heating condition may include a condition in which the door of the second storage compartment 13 is not opened. When the door of the second storage compartment 13 is opened, the operation of the second cooling fan 41 stops temporarily, and although the operation of the second cooling fan 41 stops, the measured temperature change value lacks in the discrimination, thereby causing a measurement error.

Next, according to the embodiment of the present disclosure, the frost detecting operation provided to detect the amount of frosting with respect to the second evaporator 22 of the refrigerator 1 will be described.

FIG. 18 is a flowchart showing a control process in which the defrosting operation is performed by determining a defrosting requirement time of the refrigerator according to the embodiment of the present disclosure. FIGS. 16 and 19 are state graphs showing change in the temperature that is measured by the frosting sensor before and after frosting of the second evaporator according to the embodiment of the present disclosure.

FIG. 16 is a state view showing change in temperature the second storage compartment 13 and change in temperature of the heating element before frosting of the second evaporator 22. FIG. 19 is a state view showing change in temperature of the second storage compartment and change in temperature of the heating element when frosting of the second evaporator is in progress.

As shown in the drawings, after the preceding frosting operation terminates, at S1, cooling operation of each storage compartment 12, 13 based on the first set reference temperature and the second set reference temperature is performed under the control of the controller 80, at S110.

At this point, the above-described cooling operation is performed under the operation control of at least any one of the first evaporator 21 and the first cooling fan 31 according to the first operational reference value designated on the basis of the first set reference temperature, and the cooling operation is performed under the operation control of at least any one of the second evaporator 22 and the second cooling fan 41 according to the second operational reference value designated on the basis of the second set reference temperature.

For example, when the internal temperature of the first storage compartment 12 is within the dissatisfaction temperature region divided on the basis of the first set reference temperature set by the user, the controller 80 controls the first cooling fan 31 to be operated, and when the internal temperature is within the satisfaction temperature region, the controller 80 controls the first cooling fan 31 to stop operating.

Specifically, when the internal temperature of the first storage compartment 12 reaches the first lower limit temperature NT-DIFF1 on the basis the first set reference temperature, the controller 80 stops operation for cold air supply.

However, when the internal temperature rises on the basis of the first set reference temperature, the operation for cold air supply is resumed before the reaching the first upper limit temperature NT+DIFF1.

After the internal temperature of the first storage compartment 12 reaches the first lower limit temperature NT-DIFF1, the controller 80 may control the refrigerant valve 63 such that the first refrigerant path 61 is closed and the second refrigerant path 62 is opened.

At this point, after the internal temperature of the first storage compartment 12 reaches the first lower limit temperature NT-DIFF1, the controller 80 may control the first cooling fan 31 to be operated for a predetermined time.

Furthermore, when the internal temperature of the first storage compartment 12 reaches the first upper limit temperature NT+DIFF1, the controller 80 may control the refrigerant valve 63 such that the first refrigerant path 61 is opened and the second refrigerant path 62 is closed.

At this point, the controller 80 may control the first cooling fan 31 to supply cold air, and control to reduce the amount of cold air supplied by the second cooling fan 41.

In addition, during the general cooling operation described above, coming up of the cycle for the frost detecting operation is continuously checked, at S120.

At this point, the performance cycle of the frost detecting operation may be a cycle of time, and may be a cycle in which the same operation such as a specific component or operation cycle is repeatedly performed.

In the embodiment of the present disclosure, the cycle may be a cycle in which the second cooling fan 41 is operated.

In other words, considering that the frost detecting device 70 is configured to check the amount of frosting on the second evaporator 22 on the basis of a temperature difference value (logic temperature ΔHt) in response to a change in the flux of air passing through the frosting detection flow path 710, as the logic temperature ΔHt becomes higher, the reliability of a detection result of the frost detecting device 70 may be secured, and when the second cooling fan 41 is operated, the highest logic temperature ΔHt may be secured.

At this point, the cycle may be each operation time of the second cooling fan 41 or alternating operation time of the second cooling fan 41. Of course, immediately after the defrosting operation terminates, since frequent performance of the frost detecting operation are not required, for example, the cycle may be set such that the frost detecting operation is performed for every 3 operations of the second cooling fan 41.

Furthermore, the second cooling fan 41 of the second fan duct assembly 40 may be operated while the operation of the first cooling fan 31 of the first fan duct assembly 30 stops. Of course, when necessary, the second cooling fan 41 may be controlled to be operated also when the operation of the first cooling fan 31 does not completely stop.

In addition, in order to increase a difference between temperature values in response to change in the flux of air passing through the frosting detection flow path 710, the flux of air should be large. In other words, a change in the flux of air of which reliability cannot be secured is virtually meaningless or may cause an error in determination.

Considering this, it may be preferable that the frosting sensor 730 is operated when the second cooling fan 41 having a virtually valid change in the flux of air is operated. In other words, during operation of the second cooling fan 41, it may be preferable to control the heating element 731 of the frosting sensor 730 to emit heat.

The heating element 731 may be controlled to emit heat simultaneously while power is supplied to the second cooling fan 41, or the heating element 731 may be controlled to emit heat immediately after power is supplied to the second cooling fan 41 or when a certain condition is satisfied while power has been supplied to the second cooling fan 41.

In the embodiment of the present disclosure, it is illustrated that the heating element 731 is controlled to emit heat when the certain condition is satisfied while power is supplied to the second cooling fan 41.

In other words, when the cycle for the frost detecting operation comes, when the heating condition of the heating element 731 is confirmed, at S130, and then the heating condition is satisfied, the heating element 731 is controlled to emit heat.

This heating condition is the same as the above-mentioned description.

In other words, the heating condition may include at least one of the condition, in which when power is supplied to the second cooling fan 41, rising of the temperature in the frosting detection flow path stops; the condition in which the temperature inside the frosting detection flow path 710 gradually rises by power supply to the second cooling fan 41 and then turns downward; the condition in which the temperature of the second storage compartment 13 checked by the separate temperature sensor 1*b* that senses the temperature inside the second storage compartment 13 falls over the set range despite the power supply to the second cooling fan 41; the condition in which the temperature inside the second storage compartment 13 stops rising or falls; the condition in which the heating time of the heating element 731 is shorter than the remaining operation time of the second cooling fan 41; the condition in which the second cooling fan 41 is maintained at a middle speed or more; and the condition in which the rotation speed of the second cooling fan 41 is maintained without change.

Of course, the heating condition may include the basic condition.

The basic heating condition may include at least any one basic condition of the condition in which after the second cooling fan 41 is operated and the set time elapses, the heating element is controlled to automatically emit heat; the condition in which before the second cooling fan 41 is operated the internal temperature (temperature checked by temperature sensor) of the frosting detection flow path 710 gradually falls; the condition in which the second cooling fan 41 is in operation; and the condition in which the door of the second storage compartment 13 is not opened.

In addition, when it is confirmed that the above-described heating condition is satisfied, while power is supplied to the heating element 731 under the control of the controller 80 (or control of sensor PCB), the heating element 731 emits heat, at S140.

Furthermore, when the above-described heating of the heating element 731 is performed, the temperature sensor 732 detects a material property of the fluid in the frosting detection flow path 710, e.g., the temperature Ht1, at S150.

The temperature sensor 732 may detect the temperature Ht1 simultaneously while the heating element 731 emits heat, and after heat-emission of the heating element 731 is performed, the temperature sensor 732 may detect the temperature Ht1.

Specifically, the temperature Ht1 detected by the temperature sensor 732 may be the minimum temperature inside the frosting detection flow path 710 to be checked after the heating element 731 is turned ON.

The detected temperature Ht1 may be stored in the controller (or sensor PCB).

In addition, the heating element 731 emits heat for a set heating time. At this point, the set heating time may be time that may have the discrimination for a change in temperatures inside the frosting detection flow path 710.

For example, it is preferable that the logic temperature ΔHt when the heating element 731 emits heat for the set heating time has the discrimination except for the logic temperature ΔHt by predicted or unpredicted other factors.

The set heating time may be a specific time, or may be time that is variable in response to the peripheral environment.

For example, the set heating time may be time shorter than a difference between the time, which is required for the changed cycle when the operational cycle of the first cooling fan 31 for the cooling operation of the first storage compartment 12 is changed to be shorter than the preceding operational cycle, and the time required for the above-described heating condition.

Furthermore, the set heating time may be time shorter than a difference between the time changed when the operational time of the second cooling fan 41 for the cooling operation of the second storage compartment 13 is changed to be shorter than the preceding operational time, and the time required for the above-described heating condition.

Furthermore, the set heating time may be time shorter than the operational time of the second cooling fan 41 when the second storage compartment 13 is operated at the maximum load.

Furthermore, the set heating time may be time shorter than a difference between the time for the second cooling fan 41 to be operated in response to a change in the internal temperature of the second storage compartment 13 and the time required for the above-described heating condition.

Furthermore, the preset heating time may be time shorter than a difference between the operation time of the second cooling fan 41 changed in response to the designated internal temperature of the second storage compartment 13 designated by the user and the time required for the above-described heating condition.

In addition, when the set heating time elapses, while the supply of power to the heating element 731 is interrupted, heat-emission of the heating element 731 may stop, at S160.

Of course, even when the heating time does not elapse, supply of power to the heating element 731 may be controlled to be interrupted.

For example, when the temperature detected by the temperature sensor 732 exceeds a set temperature value (e.g., 70° C.), the supply of power to the heating element 731 may be controlled to be interrupted, and when the door of the second storage compartment 13 is opened, the supply of power to the heating element 731 may be controlled to be interrupted.

When unexpected operation of the first storage compartment 12 (operation of first cooling fan) occurs, the supply of power to the heating element 731 may be controlled to be interrupted.

When the second cooling fan 41 is turned OFF, the supply of power to the heating element 731 may be controlled to be interrupted.

As described above, when heat-emission of the heating element 731 stops, a value of a material property of the frosting detection flow path 710 detected by the temperature sensor 732, i.e., the temperature Ht2 may be detected, at S170.

At this point, the temperature detection of the temperature sensor 732 may be performed simultaneously with the stopping of heat-emission of the heating element 731, and may be performed after heat-emission of the heating element 731 stops.

Specifically, the temperature Ht2 detected by the temperature sensor 732 may be the highest internal temperature of the frosting detection flow path 710 checked at the time before and after the heating element 731 is turned off.

The detected temperature Ht2 may be stored in the controller 80 (or, sensor PCB).

In addition, the controller 80 (or sensor PCB) may calculate each logic temperature ΔHt on the basis of each detected temperature Ht1, Ht2, and may determine whether or not the defrosting operation with respect to the cooling source 22 (second evaporator) is performed, on the basis of the logic temperature ΔHt calculated as described above.

In other words, after calculating at S180 and storing a difference value ΔHt between the temperature Ht1 when the heating element 731 emits heat and the temperature Ht2 when heat-emission of the heating element 731 terminates, the controller 80 may determine whether or not the defrosting operation is performed, on the basis of the logic temperature ΔHt.

For example, when the logic temperature ΔHt is higher than the set first reference difference value, the flux of air in the frosting detection flow path 710 is less, and thus the controller may determine that the amount of frosting on the second evaporator 22 is less than the amount of frosting required for the defrosting operation.

In other words, when the amount of frosting on the second evaporator 22 is less, a difference between a pressure at an air inlet and a pressure at an air outlet of the second evaporator 22 is small, and thus the flux of air flowing in the frosting detection flow path 710 is small, so that the logic temperature ΔHt is relatively high.

On the other hand, when the logic temperature ΔHt is lower than the set second reference difference value, the flux of air in the frosting detection flow path 710 is large, so that the controller may determine that the amount of frosting on the second evaporator 22 is sufficient to perform the defrosting operation.

In other words, when the amount of frosting on the second evaporator 22 is large, a difference between a pressure at the air inlet and a pressure at the air outlet of the second evaporator 22 is great, and the flux of air flowing in the frosting detection flow path 710 is large due to the difference in pressure, so that the logic temperature ΔHt is relatively low.

At this point, the second reference difference value may be a value that is set sufficiently to perform the defrosting operation. Of course, the first reference difference value and the second reference difference value may be the same value, or the second reference difference value may be set as a lower value than the first reference difference value.

The first reference difference value and the second reference difference value may be one specific value or be a value in a range.

For example, the second reference difference value may be 24° C., and the first reference difference value may be the temperature in the range from 24° C. to 30° C.

In addition, in response to a result of the above-described determination, when the logic temperature ΔHt confirmed by the controller 80 is higher than the set first reference difference value, it may be determined that the amount of frosting on the second evaporator 22 failed to reach the set amount of frosting.

In this case, after operation of the second cooling fan 41 stops, frosting detection may stop until a following cycle is operated.

Next, when the operation of the following cycle of the second cooling fan 41 is performed, the process of determining whether or not the heating condition for the frosting detection is satisfied may be repeatedly performed.

However, when the logic temperature ΔHt confirmed by the controller 80 is lower than the set second reference difference value, the controller may determine that the second evaporator 22 exceeds the set amount of frosting, and the defrosting operation may be controlled to be performed, at S2.

At this point, when the defrosting operation is performed, the logic temperature ΔHt for each frosting detection cycle that is stored may be reset.

In addition, the logic temperature ΔHt checked by the frosting detecting device 70 may be sequentially stored for each frosting detection until the defrosting operation is performed, and may be compared.

In other words, when using the logic temperature ΔHt that is sequentially stored as described, not only whether or not frosting of the second evaporator 22 occurs, but also at least any one problem of an error of the temperature sensor 732, clogging of the frosting detection flow path 710, freezing of the heating element 731, freezing of the second cooling fan 41, and remaining ice of the second evaporator 22 may be confirmed.

For example, although the logic temperature ΔHt sequentially stored should gradually fall as the order goes on, when the logic temperature ΔHt of the present order is confirmed to be higher than the logic temperature ΔHt of the preceding order, it may be determined as clogging of the frosting detection flow path 710 or freezing of the second cooling fan 41.

Furthermore, although the logic temperature ΔHt that is sequentially stored should fall as the order goes on, when the logic temperature ΔHt of the present order is confirmed to be sharply lower than the logic temperature ΔHt of the preceding order, it may be determined as an error or freezing of the heating element 731.

Furthermore, although the defrosting operation is performed, when the logic temperature ΔHt fails to reach the initial temperature difference value, it may be determined that remaining frost exists.

Of course, checking the above-described situations may be possible when the logic temperature ΔHt has sufficient discrimination. In other words, as the logic temperature ΔHt becomes higher, the discrimination is improved and thus various situations may be determined.

Meanwhile, during performance of the above-described frost detecting operation, a situation in which the heating condition of the heating element 731 is not satisfied or an unexpected situation may occur.

In other words, it is set that heat-emission of the heating element 731 for the frost detecting operation is performed when the heating condition is satisfied, and although the heating time of the heating element 731 is set to be shorter than the minimum operating time of the second cooling fan 41 that is changed according to the internal environment or a temperature setting of the user, an error in the frosting detection may occur.

Accordingly, during the frost detecting operation that is performed cyclically every time power is supplied to the second cooling fan 41, when the heating condition is not satisfied, it is controlled that the heating element 731 does not emit heat and the frost detecting operation at the present cycle terminates.

In other words, it may be preferable that improvement of the power consumption efficiency is achieved as the heating element 731 does not emit heat.

In this unexpected situation, a situation of opening of the door of the first storage compartment 12 or the second storage compartment 13 during the frost detecting operation may be included.

In this unexpected situation, a situation in which during the frost detecting operation the time required for the heating condition of the heating element 731 to be satisfied is higher than the minimum time may be included.

The frost detecting operation as described above may be performed periodically, and the cycle may be a cycle according to the time or a cycle according to the operation of the second cooling fan 41.

Furthermore, when the cyclically frost detecting operation is performed and the heating condition is not satisfied, the frost detecting operation of the present cycle terminates and the information obtained in the present cycle is deleted so that the information is not stored.

A cycle of the periodically frost detecting operation may not be constant.

For example, the frost detecting operation that is performed after completion of the defrosting operation is provided to check various defects and may not be performed every time power is supplied to the second cooling fan 41.

In other words, in response to the temperature range of the logic temperature ΔHt obtained by performing the frost detecting operation, the cycle of the frost detecting operation may be set variously, for example, as one performance for each 5th power supply to the second cooling fan 41, one performance for each 3th power supply to the second cooling fan 41, or one performance for every power supply to the second cooling fan 41.

Of course, when the logic temperature ΔHt is within the temperature range that requires attention, it may be preferable to perform the frost detecting operation for each power supply to the second cooling fan 41.

Meanwhile, the operation time of the above-described frost detecting operation may be differently set in response to the room temperature measured by the first temperature sensor.

In other words, the controller 80 may perform a control such that the frost detecting time performed within a temperature region with the high room temperature is performed shorter than the frost detecting time performed within a temperature region with the low room temperature.

For example, in the temperature region with the room temperature higher than 32° C., the frost detecting time is controlled to be performed shorter than in the temperature region with the room temperature lower than 15° C.

Furthermore, the frost detecting time may be controlled to vary in response to a value of the internal temperature of the storage compartment.

In other words, the controller 80 performs control such that the frost detecting time within a temperature region with a high temperature value of the internal temperature measured by the second temperature sensor is performed shorter than the frost detecting time within a temperature region with a low internal temperature.

For example, in the temperature region with the internal temperature higher than 16° C., the frost detecting time is controlled to be performed shorter than in the temperature region with the internal temperature lower than 24° C.

Next, according to the embodiment of the present disclosure the refrigerator, a process S2 of performing the defrosting operation with respect to the second evaporator 22 will be described below.

First, after the heating element 731 is turned off, the defrosting operation may be performed by determination of the controller 80.

When the defrosting operation is performed, the first heater 51 constituting the defrosting device 50 may emit heat.

In other words, it is configured that heat generated by heat-emission of the first heater 51 is used to remove frost generated on the second evaporator 22.

At this point, when the first heater 51 comprising of the sheath heater is turned on, heat generated by the first heater 51 removes frost generated on the second evaporator in radiation and convection.

Furthermore, when the defrosting operation is performed, the second heater 52 constituting the defrosting device 50 may emit heat.

In other words, it is configured that heat generated by heat-emission of the second heater 52 is used to remove frost generated on the second evaporator 22.

At this point, when the second heater 52 comprising of the L-cord heater is turned on, heat generated by the second heater 52 is conductive into a heat-exchange fin, thereby removing frost generated on the second evaporator 22.

The first heater 51 and the second heater 52 may be controlled to emit heat simultaneously, or it may be controlled that the first heater 51 emits heat preferentially and then the second heater 52 emits heat, or it may be controlled that the second heater 52 emits heat preferentially and then the first heater 51 emits heat.

In addition, after heat-emission of the first heater 51 or the second heater 52 is performed for a set time, heat-emitting of the first heater 51 or the second heater 52 stops.

At this time, even when the first heater 51 and the second heater 52 are provided together, the stopping of heat-emission may be performed in the two heaters 51 and 52, but may be controlled such that heat-emission of one of the heater is stopped preferentially and then heat-emission of the other heater is stopped next.

The time for heat-emission of each heater 51, 52 may be set by the specific time (e.g., 1 time, etc.) or may be set by the time that is variable in response to the amount of frosting.

Furthermore, the first heater 51 or the second heater 52 may be operated at the maximum load, or operated at the load that is variable in response to the amount of defrosting.

In addition, when the defrosting operation depending on operation of the defrosting device 50 is performed, the heating element 731 constituting the frosting sensor 730 may be controlled to emit heat with the defrosting operation.

In other words, in the defrosting operation, considering that water caused by frost melting may also flow into the frosting detection flow path 710, it may be preferable that the heating element 731 also emits heat to prevent the flowing water from being frozen in the frosting detection flow path 710.

Furthermore, the defrosting operation may be performed on the basis of time, or temperature.

In other words, when the defrosting operation is performed for randomized time, the defrosting operation may be controlled to terminate, and when the temperature of the second evaporator 22 reaches the set temperature, the defrosting operation may be controlled to terminate.

In addition, when operation of the above-described defrosting device 50 is completed, the first cooling fan 31 is operated at the maximum load to allow the first storage compartment 12 to reach the set temperature range and then the second cooling fan 41 is operated at the maximum load, so that the second storage compartment 13 may reach the set temperature range.

At this point, when the first cooling fan 31 is operated, the refrigerant compressed from the compressor 60 may be controlled to be supplied to the first evaporator 21, and when the second cooling fan 41 is operated, the refrigerant compressed from the compressor 60 may be controlled to be supplied to the second evaporator 22.

In addition, when the temperature conditions of the first storage compartment 12 and the second storage compartment 13 are satisfied, the above-described control for the frosting detection of the second evaporator 22 performed by the frost detecting device 70 is successively performed.

Of course, immediately after operation of the defrosting device 50 is completed, it may be preferable to detect remaining ice to determine whether or not additional defrosting operation is required.

In other words, when remaining ice is checked, as additional defrosting operation is performed even though the defrosting operation time does not come up, the remaining ice may be completely removed.

Meanwhile, the defrosting operation may not be performed only based on the information obtained by the frost detecting device 70.

For example, due to the user's negligence, the door of any one storage compartment may be opened for a long time (including tiny-opening, etc.).

This state may be recognized by a sensor that performs opening detection of the door, and in this case, the defrosting operation may be set to be forcibly performed when a certain time elapses without operating the frost detecting device 70.

Furthermore, when the frosting detection operation is not cyclically performed due to excessive frequent opening and closing of the door, without using the information obtained by the frost detecting device 70, the defrosting operation may be set to be forcibly performed at set time considering frequent opening and closing of the door.

As described above, the refrigerator 1 of the present disclosure is configured to perform the frost detecting operation that checks frosting of the second evaporator 22 in consideration of the cooling operation in response to the internal environment of the first storage compartment 12 or the second storage compartment 13 or the temperature set by the user, so that the frosting detection may be precise performed.

In other words, when the operation time of the second cooling fan 41 is set shorter than the operation time in normal operation due to the internal environment or the user-set temperature, the frost detecting operation is performed within the operation time of the second cooling fan 41, so that the reliability of the frosting detection may be improved.

Furthermore, in the refrigerator 1 of the present disclosure, the heating condition of the heating element 731 may include a condition in which the heating time of the heating element 731 is shorter than the remaining driving time of the second cooling fan 41, thereby reducing an error in the frost detecting operation and improving the measurement reliability with respect to frosting.

In other words, the refrigerator 1 of the present disclosure is configured to sufficiently secure the heating time of the heating element 731 constituting the frost detecting device 70, and the discrimination in a temperature change may be improved.

Specifically, since it is determined that the heating condition is satisfied when the heating time of the heating element 731 is shorter than the remaining driving time of the second cooling fan 41, when the heating condition is not satisfied, the heating element 731 does not emit heat and power consumption may be reduced.

Furthermore, the refrigerator 1 of the present disclosure is configured to allow more precise frosting detection as the heating condition for heat-emission of the heating element 731 that may maximally improve the discrimination of the logic temperature $\Delta Ht$ is applied, and the defrosting operation that is performed on the basis of the frosting detection may be also performed when exactly necessary, so that the consumption efficiency may be further improved.

Meanwhile, the refrigerator of the present disclosure is not limited to being applied only to the structure in which two storage compartments are provided or two evaporators are provided.

In other words, the present disclosure may be applied to a refrigerator having a structure in which only one storage compartment is provided or only one evaporator is provided. Various configurations are possible.

As described above, the refrigerator of the present disclosure may be applied to various models.

The invention claimed is:

1. A refrigerator comprising:

a casing providing a storage compartment;

a door to open and close the storage compartment;

a first temperature sensor to measure a room temperature outside the storage compartment;

a second temperature sensor to measure an internal temperature of the storage compartment;

a cooling source to cool a fluid supplied to the storage compartment;

a first duct to guide the fluid inside the storage compartment to move to the cooling source;

a second duct to guide the fluid around the cooling source to move to the storage compartment;

a controller configured to adjust an amount of fluid supply, based on the room temperature measured by the first temperature sensor and the internal temperature of the storage compartment measured by the second temperature sensor; and a frost detecting device to detect an amount of frost or ice generated on the cooling source, a cooling fan to circulate the fluid around the cooling source into the storage compartment, wherein, based on the internal temperature of the storage compartment being within a dissatisfaction temperature region that is divided by an upper limit temperature on the basis of a set reference temperature set by a user for the storage compartment, the controller is configured to adjust the amount of fluid supply to increase so that the internal temperature of the storage compartment falls, and based on the internal temperature of the storage compartment being within a satisfaction temperature region divided by a lower limit temperature on the basis of the set reference temperature, the controller is configured to adjust the amount of fluid supply to be reduced, the frost detecting device comprises a frosting detection flow path to provide a flow path to allow a portion of the fluid to flow, and a frosting sensor disposed at the frosting detection flow path to measure a material property of the portion of the fluid passing through the frosting detection flow path, the controller is configured to control the frost detecting device to perform a frost detecting operation for a frost detecting time that is set, the controller is configured to control the frost detecting time of the frost detecting operation to be differently performed, on the basis of at least one of the room temperature and the set reference temperature, and wherein the controller is configured to stop the frost detecting operation based on the cooling fan being turned off while the frost detecting operation is performed.

2. The refrigerator of claim 1, wherein at least a part of the frosting detection flow path is disposed in a flow path between the first duct and the cooling source.

3. The refrigerator of claim 1, wherein at least a part of the frosting detection flow path is disposed in a flow path between the second duct and the storage compartment.

4. The refrigerator of claim 1, wherein the material property comprises at least one of temperature, pressure, and flux.

5. The refrigerator of claim 1, wherein the frosting sensor comprises a sensor and a detecting derivative.

6. The refrigerator of claim 1, wherein the cooling source comprises at least one of a thermoelectric module or an evaporator.

7. The refrigerator of claim 1, wherein the controller is configured to control the frost detecting time to vary in response to a value of the room temperature measured by the first temperature sensor.

8. The refrigerator of claim 1, wherein the controller is configured to perform control such that the frost detecting time within a temperature region where a value of the room temperature measured by the first temperature sensor is high is performed shorter than the frost detecting time within a temperature region where a value of the room temperature is low.

9. The refrigerator of claim 1, wherein the controller is configured to perform control such that the frost detecting time varies on the basis of the set reference temperature.

10. The refrigerator of claim 1, wherein the controller is configured to perform control such that the frost detecting time within a temperature region where the set reference temperature is high is performed shorter than the frost detecting time within a temperature region where the set reference temperature is low.

11. The refrigerator of claim 1, wherein the controller is configured to stop the frost detecting operation based on the controller detecting opening of the door while the frost detecting operation is performed.

12. A refrigerator comprising:

a casing providing a storage compartment;

a door to open and close the storage compartment;

a first temperature sensor to measure a room temperature outside the storage compartment;

a second temperature sensor to measure an internal temperature of the storage compartment;

a cooling source to cool a fluid supplied to the storage compartment;

a first duct to guide the fluid inside the storage compartment to move to the cooling source;

a second duct to guide the fluid around the cooling source to move to the storage compartment;

a controller configured to adjust an amount of fluid supply, based on the room temperature measured by the first temperature sensor and the internal temperature of the storage compartment measured by the second temperature sensor; and a frost detecting device to detect an amount of frost or ice generated on the cooling source, a cooling fan to circulate the fluid around the cooling source into the storage compartment, wherein, based on the internal temperature of the storage compartment being within a dissatisfaction temperature region that is divided by an upper limit temperature on the basis of a set reference temperature set by a user for the storage compartment, the controller is configured to adjust the amount of fluid supply to increase so that the internal temperature of the storage compartment falls, and based on the internal temperature of the storage compartment being within a satisfaction temperature region divided by a lower limit temperature on the basis of the set reference temperature, the controller is configured to adjust the amount of fluid supply to be reduced, the frost detecting device comprises a frosting detection flow path to provide a flow path to allow a portion of the fluid to flow, and a frosting sensor disposed at the frosting detection flow path to measure a material property of the portion of the fluid passing through the frosting detection flow path, the controller is configured to control the frost detecting device to perform a frost detecting operation for a frost detecting time that is set, the controller is configured to control the frost detecting time of the frost detecting operation to be differently performed, on the basis of at least one of the room temperature and the set reference temperature, wherein the frost detecting operation comprises the controller configured to determine a heating condition before the controller turns a heating element on, and wherein the heating condition comprises at least one among (i) a condition in which based on power being supplied into the cooling fan, rising of temperature in the frosting detection flow path stops, (ii) a condition in which due to supply of power to the cooling fan, after a temperature in the frosting detection flow path gradually rises, the temperature turns downward, (iii) a condition in which an internal temperature of the storage compartment falls over a set range despite operation of the cooling fan, (iv) a condition in which a heating time of the heating element is shorter than a remaining operation time of the cooling fan, (v) a condition in which the cooling fan is maintained at a middle speed or more, or (vi) a condition in which a rotation speed of the cooling fan is maintained without change.

13. A refrigerator comprising:

a casing providing a storage compartment;

a door to open and close the storage compartment;

a first temperature sensor to measure a room temperature outside the storage compartment;

a second temperature sensor to measure an internal temperature of the storage compartment;

a cooling source to cool a fluid supplied to the storage compartment;

a first duct to guide the fluid inside the storage compartment to move to the cooling source;

a second duct to guide the fluid around the cooling source to move to the storage compartment;

a controller configured to adjust an amount of fluid supply, based on the room temperature measured by the first temperature sensor and the internal temperature of the storage compartment measured by the second temperature sensor; and a frost detecting device to detect an amount of frost or ice generated on the cooling source, wherein, based on the internal temperature of the storage compartment being within a dissatisfaction temperature region that is divided by an upper limit temperature on the basis of a set reference temperature set by a user for the storage compartment, the controller is configured to adjust the amount of fluid supply to increase so that the internal temperature of the storage compartment falls, and based on the internal temperature of the storage compartment being within a satisfaction temperature region divided by a lower limit temperature on the basis of the set reference temperature, the controller is configured to adjust the amount of fluid supply to be reduced, the frost detecting device comprises a frosting detection flow path to provide a flow path to allow a portion of the fluid to flow, and a frosting sensor disposed at the frosting detection flow path to measure a material property of the portion of the fluid passing through the frosting detection flow path, the controller is configured to control the frost detecting device to perform a frost detecting operation for a frost detecting time that is set, the controller is configured to control the frost detecting time of the frost detecting operation to be differently performed, on the basis of at least one of the room temperature and the set reference temperature, wherein the frost detecting operation comprises the controller configured to determine a heating condition before the controller turns a heating element on, and wherein the heating condition comprises a condition in which the internal temperature of the storage compartment stops rising or falls.

* * * * *